United States Patent [19]

Sato et al.

[11] 4,438,186

[45] Mar. 20, 1984

[54] ELECTROPHOTOGRAPHIC PROCESS AND PHOTOSENSITIVE SCREEN FOR USE IN SUCH PROCESS

[75] Inventors: Eiichi Sato, Tama; Akira Shimizu, Fuchu; Kazuhisa Yanagisawa, Mitaka, all of Japan

[73] Assignee: Olympus Optical Company Limited, Tokyo, Japan

[21] Appl. No.: 275,588

[22] Filed: Jun. 19, 1981

Related U.S. Application Data

[63] Continuation of Ser. No. 913,907, Jun. 8, 1978, abandoned.

[30] Foreign Application Priority Data

| | | | |
|---|---|---|---|
| Jun. 9, 1977 | [JP] | Japan | 52-68118 |
| Jun. 17, 1977 | [JP] | Japan | 52-71142 |
| Jun. 17, 1977 | [JP] | Japan | 52-71143 |
| Jun. 17, 1977 | [JP] | Japan | 52-71144 |
| Jun. 17, 1977 | [JP] | Japan | 52-71145 |
| Jun. 17, 1977 | [JP] | Japan | 52-71146 |

[51] Int. Cl.[3] ..... G03G 15/00

[52] U.S. Cl. ..... 430/53; 430/55; 430/68

[58] Field of Search ..... 430/53, 55, 68

[56] References Cited

U.S. PATENT DOCUMENTS

| | | | |
|---|---|---|---|
| 3,666,364 | 5/1972 | Marushima | 430/55 |
| 3,676,117 | 7/1972 | Kinoshita | 430/51 |
| 3,677,751 | 7/1972 | Ohta et al. | 430/68 |
| 3,781,108 | 12/1973 | Ogawa et al. | 430/55 |
| 3,850,628 | 11/1974 | Pressman | 430/68 |
| 3,980,474 | 9/1976 | Jackson | 346/159 |
| 3,986,871 | 10/1976 | Blades et al. | 430/68 |
| 4,046,466 | 9/1977 | Ando et al. | 430/68 |
| 4,052,206 | 10/1977 | Anzai | 430/55 |
| 4,083,720 | 4/1978 | Nakatsubo et al. | 430/68 |
| 4,092,160 | 5/1978 | Jackson et al. | 430/68 |

*Primary Examiner*—John E. Kittle
*Assistant Examiner*—John L. Goodrow
*Attorney, Agent, or Firm*—Fleit, Jacobson, Cohn & Price

[57] ABSTRACT

In a process for forming electrophotographically a duplicated copy of a document by modulating a corona ion stream passing through fine apertures of a photosensitive screen in accordance with a primary electrostatic charge latent image formed on the photosensitive screen use is made of the photosensitive screen comprising an electrically conductive sheet-like member having a great number of fine apertures, a photoconductive member applied on at least one side of the conductive member and an electrically insulating member applied on the other side of the conductive member, the conductive member being completely surrounded by the photoconductive and insulating members. An improved process for forming the primary charge latent image on said screen includes a step for subjecting the photosensitive screen to an imagewise exposure corresponding to an image of the document simultaneously with electrostatically charging the screen; and a step for subjecting the photosensitive screen to a uniform exposure to form on the insulating layer of the screen the primary electrostatic charge latent image corresponding to an image of the document to be duplicated and having extremely high electrostatic contrast.

22 Claims, 88 Drawing Figures

ELECTROPHOTOGRAPHIC PROCESS AND PHOTOSENSITIVE SCREEN FOR USE IN SUCH PROCESS

This is a continuation of application Ser. No. 913,907, filed June 8, 1978, now abandoned.

BACKGROUND OF THE INVENTION

The present invention relates to a method for forming electrophotographically duplicated images with the aid of a photosensitive screen having a great number of fine apertures.

An electrophotographic process using a photosensitive screen has been known from, for example U.S. Pat. No. 3,680,954. In this known process use is made of a photosensitive screen comprising an electrically conductive mesh-like member having a photoconductive layer applied thereon. This photosensitive screen has several drawbacks in that a primary electrostatic latent image formed on the photoconductive layer cannot have a high surface potential and the electrostatic latent image cannot be maintained stably for a long time period due to a relatively large dark decay. Therefore it is practically difficult to form a number of secondary electrostatic latent images with the aid of the single primary latent image once formed on the screen.

In Japanese Laid-open Patent Application No. 341/76 there is described another electrophotographic process. In this method the primary latent image is formed on the photosensitive screen by means of the following successive steps; i.e. a primary voltage application step for uniformly charging the photosensitive screen, a step for projecting an optical image of a document to be duplicated on to the screen, and a secondary voltage application step for changing the surface potential of the screen in accordance with the projected pattern. After the primary latent image has been formed in the manner mentioned above, an ion stream is passed through the screen from an ion source and is modulated in accordance with the primary latent image on the screen so as to form a secondary electrostatic latent image on a record medium such as a record paper.

FIG. 1 is a cross sectional view showing the photosensitive screen described in the above mentioned Japanese Laid-open Patent Application. The screen 1 comprises a conductive substrate 2 having a great number of fine apertures, a photoconductive layer 3 applied on a part of the substrate 2 and an insulating layer 4 applied on the photoconductive layer 3. In the primary voltage application step a corona wire 5 is arranged opposite to the insulating layer 4 and a corona voltage supply source 6 is connected across the corona wire 5 and the conductive substrate 2 of the screen 1 as shown in FIG. 2. On the other hand if the corona discharge is effected from the opposite side, the corona ion stream might flow into the substrate 2 and thus the insulating layer 4 could not be sufficiently charged.

Next as illustrated in FIG. 3 with respect to the screen 1 having the primary charge, an imagewise exposure step and a secondary voltage application step are effected simultaneously. That is to say a corona wire 7 is arranged opposite to the insulating layer 4 and a document 8 to be copied is arranged behind the corona wire 7. While a light image of the document 8 is projected on to the screen a D.C. voltage 9 having an A.C. voltage 10 superposed thereon is applied across the conductive member 2 of the screen 1 and the corona wire 7. Then primary latent image is formed on the insulating layer 4 of screen 1.

Then as shown in FIG. 4 the screen 1 is illuminated with uniform light. By this uniform exposure electrostatic charge is formed on the insulating layer 4 in such a manner that at the dark portion of the light image an electric field is formed for enhancing or accelerating the passage of the ion stream through the apertures of the screen, and at the bright portion an electric field for preventing or blocking the passage of ion stream through the screen are formed, respectively. In this manner a primary latent image having a high contrast is formed on the photosensitive screen 1.

FIG. 5 illustrates a step for forming a secondary latent image on a record member by modulating the corona ion stream in accordance with the primary latent image formed on the screen. To this end a corona wire 11 is arranged opposite to the conductive substate 2 and a counter or back electrode 12 is provided on which electrode is placed a record member 13. Across the corona wire 11 and the back electrode 12 are connected a corona voltage source 14 and an accelerating voltage source 15 in such a manner that a potential difference is produced from the corona wire 11 toward the screen 1 and back electrode 12. Then the corona ion stream is forced to flow from the corona wire 11 toward the record member 13. However at the bright portion of the primary charge image on the screen 1 there is formed the field $\alpha$ having the direction for blocking the passage of corona ion stream (shown by broken lines) and thus the corona ion does not pass through the screen, but flows into the exposed conductive substrate 2. Whilst at the dark portion of the primary image on screen 1, since there is formed the field $\beta$ having the direction for accelerating the corona ion stream the ion stream is forced to pass through the screen and reaches the record member 13. In this manner on the record member 13 there is formed a secondary latent image corresponding to the primary latent image formed on the screen 1.

In the above mentioned known electrophotographic process the electrostatic charges on the screen forming the primary latent image are balanced with respect to the electrostatic charge of opposite polarity on screen 1.

In the above mentioned known electrophotographic process, since there are formed electrostatic charges of opposite polarities on respective surfaces of the insulating layer 4 and these charges are balanced electrostatically, the charge on the insulating layer 4 is scarcely cancelled by the corona ion for forming the secondary latent image even if the corona ion has the opposite polarity to that of the primary latent image formed on the insulating layer 4. Therefore it is possible to form a number of the secondary latent images by repeatedly subjecting the secondary latent image forming step to the primary latent image once formed on the screen 1.

However as shown in FIG. 2 even if the corona charging is effected from the insulating layer side, a relatively large part of the corona ions practically flows into the exposed conductive substrate 2 and thus the potential on the insulating layer 4 would not be sufficiently high. Therefore the contrast of the primary latent image obtained after the uniform exposure step shown in FIG. 4 is not high, and thus only a limited number of duplicated copies of good quality can be obtained from the single primary latent image once formed on the screen 1.

In U.S. patent application Ser. No. 19,787, filed on Nov. 11, 1971 there is described still another known electrophotographic process. A photosensitive screen for use in this known process is of a four-layer construction and comprises a conductive mesh-like sheet member, a photoconductive layer applied on one side of the mesh member, an insulating layer applied on the other side of the conductive member and a conductive layer applied on the insulating layer. Since the primary latent image is formed on the photoconductive layer the dark decay is large and a primary latent image of good quality can not be maintained for a long time period as in the case of the first mentioned known electrophotographic process. Moreover, there might occur a spark due to the breakdown in the insulating layer upon applying a bias voltage across the conductive substrate and conductive layer. Further, the photosensitive screen of four-layer construction is very complicated, and it is quite difficult to manufacture such a screen.

SUMMARY OF THE INVENTION

The present invention has for its object to provide an electrophotographic process which can obviate the various drawbacks of the above mentioned known processes and can form a primary latent image having a higher surface potential and thus a higher electrostatic contrast so that a great number of copies of good quality can be printed from the single primary latent image.

In an electrophotographic process according to the invention use is made of a photosensitive screen comprising a conductive mesh-like member having a number of fine apertures, a photoconductive layer applied on one side of the conductive member and an insulating layer applied on the other side of the conductive member, the conductive member being completely covered with said photoconductive and insulating layers and upon formation of a primary latent image for modulating an ion stream to form a secondary latent image said process comprising a step for effecting a light image projection simultaneously with charging and a step for uniformly exposing the screen.

The present invention also relates to a photosensitive screen for use in the electrophotographic process.

It is another object of the invention to provide a photosensitive screen which is simple in construction and can be easily manufactured.

A photosensitive screen for use in an electrophotographic process according to the invention comprises a sheet like substrate member made of electrically conductive material and having a great number of fine apertures, a photoconductive layer applied on one surface of the conductive member, and an electrically insulating layer applied on the other surface of the conductive member, said conductive member being completely covered with said photoconductive and insulating layers.

In a preferred embodiment of the photosensitive screen according to the invention there is further provided a second photoconductive layer between the conductive member and the insulating layer.

In another preferred embodiment of the photosensitive screen according to the invention the first photoconductive layer applied on the one surface of the conductive sheet is formed by photoconductive material selected from the group consisting of photoconductive material which is easily charged in a positive polarity (hereinafter referred as a-type photoconductive material), photoconductive material which is easily charged in a negative polarity (referred as b-type photoconductive material) and photoconductive material which is easily charged in both positive and negative polarities (referred as c-type photoconductive material), and the second photoconductive layer is formed by photoconductive material which is selected from said group but different from that selected for the first photoconductive layer.

BRIEF DESCRIPTION OF THE DRAWINGS

FIG. 21 illustrates an imagewise exposure and charging step, FIG. 22 a uniform exposure step and FIG. 23 depicts a step for forming a secondary charge latent image on a record medium;

FIG. 27 shows an imagewise exposure and primary charging step, FIG. 28 depicts a secondary reverse polarity charging step, FIG. 29 illustrates a uniform exposure step and FIG. 30 represents a secondary charge latent image forming step;

FIG. 47 shows a uniform exposure step;

FIG. 51 shows a uniform exposure and primary charging step, FIG. 52 represent an imagewise exposure simultaneously with a secondary opposite polarity charging step, and FIG. 53 shows a uniform exposure step;

FIG. 57 shows a uniform exposure and primary charging step, FIG. 58 an imagewise exposure and secondary opposite polarity charging step, FIG. 59 a uniform exposure step and FIG. 60 illustrates a secondary charge image forming step;

FIG. 61 represents an imagewise exposure and primary charging step, FIG. 62 a uniform exposure step, FIG. 63 a secondary opposite polarity charging step, FIG. 64 a secondary uniform exposure step and FIG. 65 a secondary charge latent image forming step;

DESCRIPTION OF THE PREFERRED EMBODIMENTS

Figure 1:
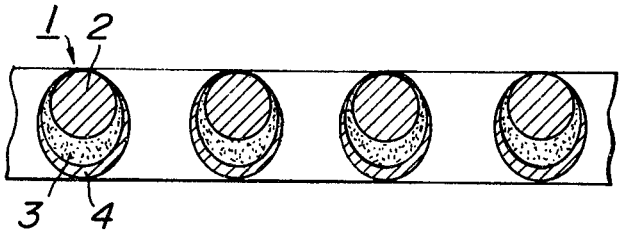
FIG. 1 is a cross section showing a known photosensitive screen for use in a known electrophotographic process.
Figure 2:
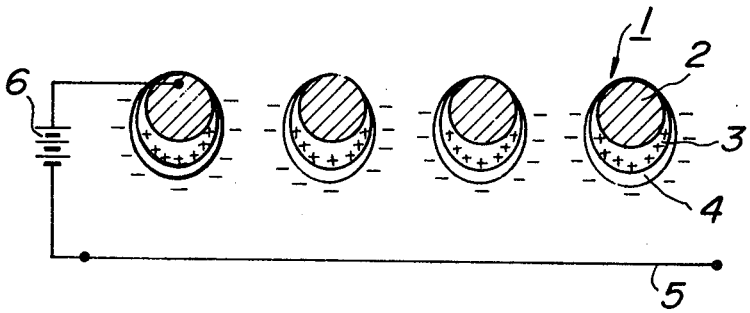
FIGS. 2, 3 and 4 are cross sections illustrating schematically successive steps for forming a primary charge latent image on the screen of FIG. 1 in accordance with a known electrophotographic process.
Figure 3:
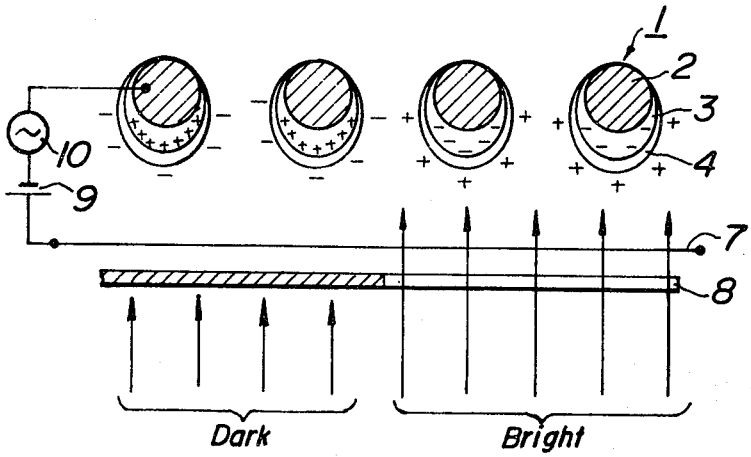
Figure 4:
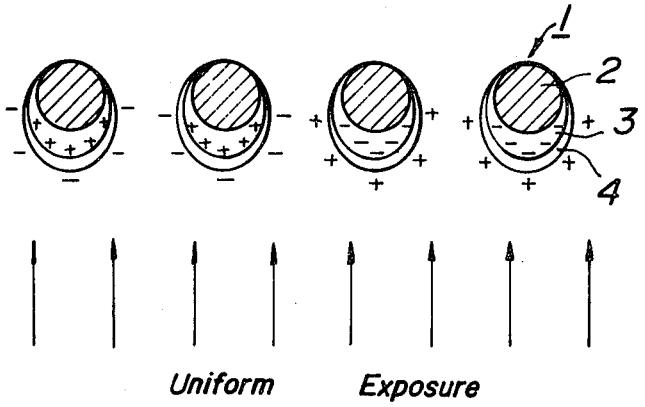
Figure 5:
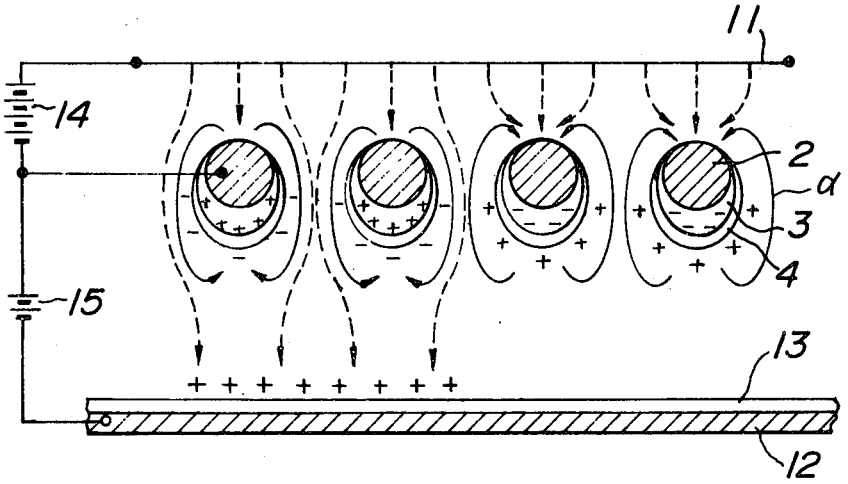
FIG. 5 is a cross section showing a step of forming a secondary charge latent image on a record medium with the aid of the screen of FIG. 1.
Figure 6:
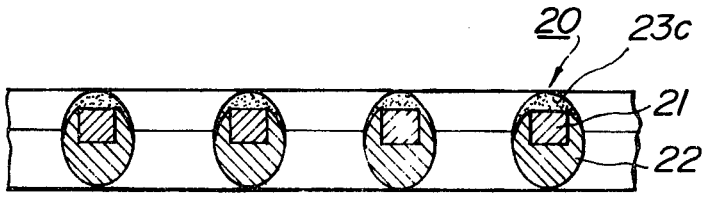
FIGS. 6, 7 and 8 are cross sections illustating three embodiments of a photosensitive screen according to the invention.

FIG. 6 is a cross section for illustrating an embodiment of a photosensitive screen according to the invention. The photosensitive screen 20 of this embodiment comprises a mesh like conductive sheet or member 21, an insulating member or layer 22 applied on the conductive sheet 21 except its one surface and a photoconductive member or layer 23*c* applied on said one surface. The conductive member 21 is completely covered with said insulating and photoconductive layers 22 and 23*c*. In this embodiment the photoconductive layer 23*c* is made of c-type photoconductive material which is easily charged either in positive or negative polarity.

Figure 7:
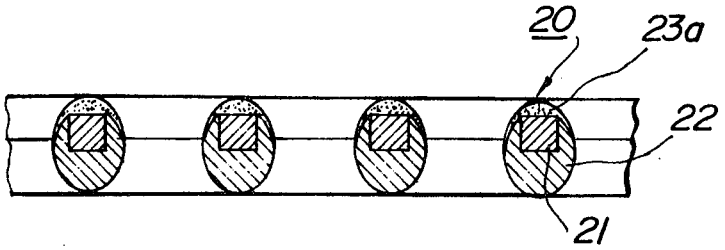

FIG. 7 is a cross section showing another embodiment of the photosensitive screen according to the invention. This screen 20 has substantially the same construction as that shown in FIG. 6, but the photoconductive layer 23*a* is made of a-type photoconductive material which is easily charged in the positive polarity, but is difficult to charge in the negative polarity.

Figure 8:
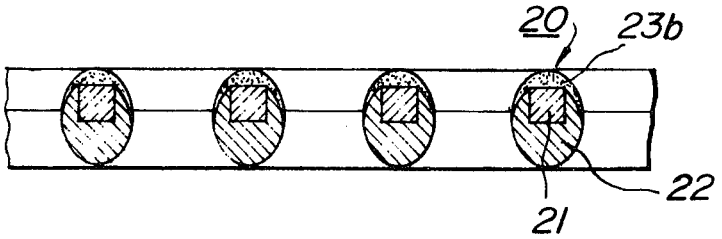

FIG. 8 shows still another embodiment of the photosensitive screen according to the invention. In this embodiment a photoconductive layer 23*b* is made of b-type photoconductive material which is easily charged in the negative polarity, but is difficult to charge in the positive polarity.

Figure 9A:
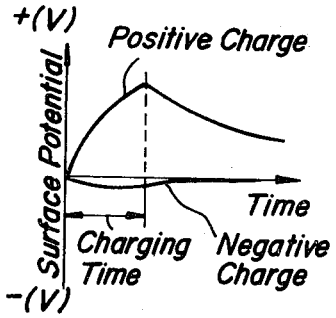
FIGS. 9*a*, 9*b* and 9*c* are graphs showing a-type, b-type and c-type photoconductive characteristics, respectively of photoconductive material for use in the screen according to the invention.
Figure 9B:
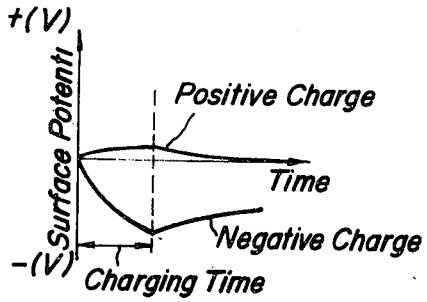
Figure 9C:
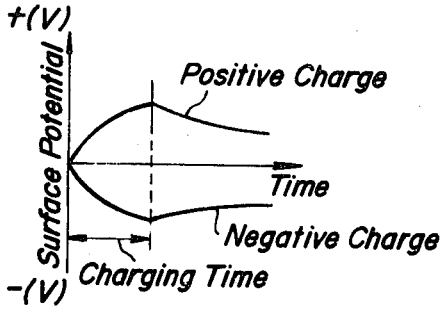

As explained above the photoconductive member provided in the photosensitive screen according to the invention is formed by the three different kinds of photoconductive material. In FIGS. 9*a*, 9*b* and 9*c* are shown characteristics of these three kinds of photoconductive material.

(a) a-type photoconductive material which is easily charged in the positive polarity (FIG. 9*a*):

(b) b-type photoconductive material which is easily charged in the negative polarity (FIG. 9*b*):

(c) c-type photoconductive material which is easily charged in either positive or negative polarities (FIG. 9*c*):

These photoconductive materials are referred to as a-type, b-type and c-type, respectively, for the sake of simplicity and are identified by adding an appendix a, b or c to reference numerals denoting the photoconductive layers.

The above explained characteristics of photoconductive materials are influenced by the junction between the conductive member 21 and the photoconductive layer 23 to a great extent, as well as a bulk property of the photoconductive layer. For example, when the photoconductive layer is formed by evaporating Se, the layer has the a-type property in the case that the conductive member 21 which serves as a substrate for evaporation is heated above 60° C., but becomes c-type at a temperature lower than 60° C. In the case of evaporating Se-Te alloy including Te by from several percentages to ten and several percentages the photoconductive layer becomes b-type when the conductive substrate 21 is heated above 60° C., but becomes c-type when the temperature of the substrate is lower than 60° C. The a-type property may be obtained by forming a thin film having a thickness of a few microns and consisting of $SeO_2$, fine crystals of Se, Te, Ge, etc. between the conductive member 21 and the photoconductive layer 23 made of Se. Further, when a thin film of $As_2S_3$ is formed at the junction of the conductive member 21 and photoconductive layer 23 made of Se, the layer possesses the c-type property. In general, CdS has a rectifying property of the b-type.

Figure 10:
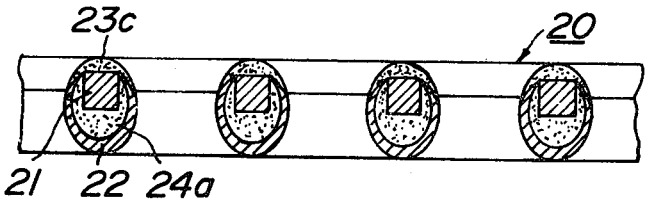
FIGS. 10, 11, 12, 13, 14, 15, 16, 17, 18, 19*a* and 19*b* are cross sections showing various embodiments of the photosensitive screen according to the invention.

FIG. 10 is a cross section illustrating a preferred embodiment of the photosensitive screen according to the invention. In this embodiment a second photoconductive layer 24*a* of a-type property is interposed between a conductive member 21 and an insulating layer 22. A first photoconductive layer 23*c* applied on the opposite surface of the conductive member 21 has the c-type property. Therefore in this embodiment two different kinds of photoconductive members are used. Several embodiments of the photosensitive screen according to the invention in which two different kinds of photoconductive materials are provided are shown in FIGS. 11 to 15.

Figure 16:
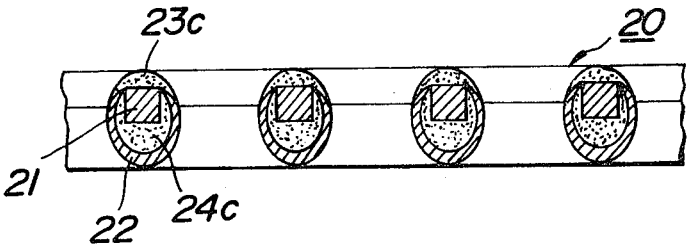
Figure 17:
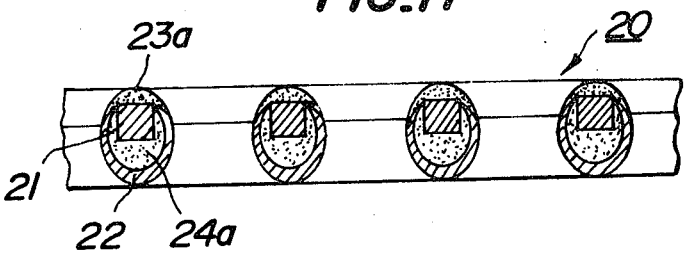
Figure 18:
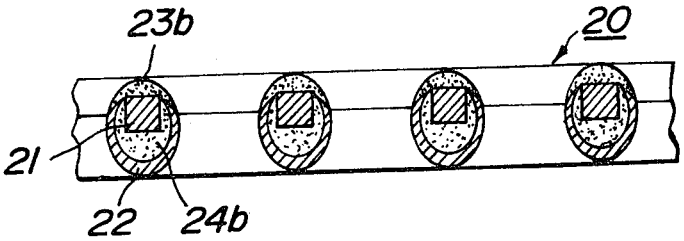

FIGS. 16, 17 and 18 are cross sections showing other embodiments of the photosensitive screen of the invention. In these embodiments the screen comprises first and second photoconductive layers having the same property.

For example, in FIG. 16 both the first and second photoconductive layers 23*c* and 24*c* have the c-type property.

It should be noted that the insulating layer 22 of the screens shown in FIGS. 10 to 18 is made transparent.

The conductive member 21 of the photosensitive screen 20 according to the invention may be formed by a metal sheet having fine apertures of 50 to 400 mesh. The photoconductive layers 23 and 24 may be formed by evaporating in vacuum metals such as Se, PbO, S, Te, Sb, Bi, alloys or intermetallic compounds, by sputtering ZnO, CdS, $TiO_2$, or by spraying or painting powders of photoconductive material such as ZnO, CdS, CdSe, $TiO_2$, PbO dissolved in electrically insulating organic binder. The photoconductive layers may be made of complex photosensitive material consisting of Se-Te alloy and organic semiconductive material. The insulating layer 22 may be formed by spraying or painting electrically insulating organic material such as polyethylene, polypropylene, polystyrene, polyurethane, polyvinyl chloride, acrylic resin, polycarbonate, silicone resin, fluoroethylene resin, or epoxy resin.

Figure 19A:
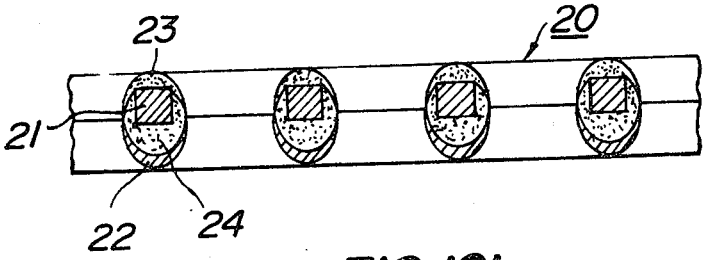
Figure 19B:
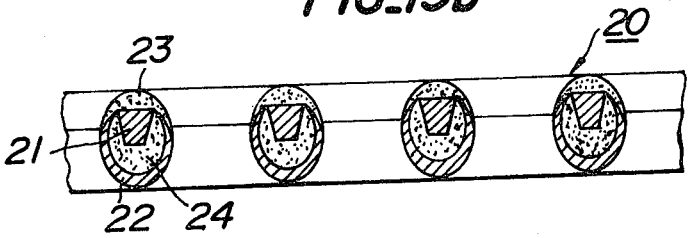

FIGS. 19*a* and 19*b* show still other embodiments of the photosensitive screen according to the invention. In FIG. 19*a* an insulating layer 22 is applied on only a part of a second photoconductive layer 24, and a first photoconductive layer 23 is joined with the second photoconductive layer 24. In FIG. 19*b* the cross sectional configuration of the conductive member 21 has a trapezoidal shape instead of a rectangular shape.

In the photosensitive screen according to the invention since the conductive member 21 is completely surrounded by the photoconductive layers 23, 24 and the insulating layer 22 corona ions do not flow directly into the conductive member 21 during the formation of the primary latent image, so that the latent image can have very high surface potential and thus a very high electrostatic contrast.

When the electrophotographic process according to the invention is carried out using the photosensitive screens shown in FIGS. 10 to 15, it is possible to form the primary latent image by means of various methods while giving the suitable properties to the first and second photoconductive layers 23 and 24 as will be explained hereinafter.

Now various examples of the electrophotographic process according to the invention will be explained.

The electrophotographic process according to the invention can be classified into the following five processes with respect to the formation of the primary latent image on the photosensitive screen. These fundamental processes will be first explained.

PROCESS A

The process A comprises the following successive steps:

1. a step for effecting an imagewise exposure simultaneously with a charging, and
2. a step for subjecting the screen to a uniform exposure.

PROCESS B

This process B includes the following successive steps:

1. a step for carrying out a light image projection simultaneously with a primary charging or electrification,
2. a step for effecting a secondary charging or electrification in the opposite polarity to that of the primary charging, and
3. a step for exposing the screen under uniform light.

PROCESS C

In the process C the following steps are carried out in succession;

1. a step for effecting a primary electrification,
2. a step for carrying out a light image projection together with a secondary electrification in the opposite polarity to that of the primary one, and
3. a step for effecting a uniform exposure.

PROCESS D

The process D comprises the following successive steps:

1. a step for carrying out a primary charging simultaneously with a uniform exposure,
2. a step for effecting an imagewise exposure simultaneously with a secondary charging in the opposite polarity to that of the primary charging, and
3. a step for effecting a uniform exposure.

PROCESS E

The last process E comprises the following steps in succession:

1. a step for carrying out a light image projection simultaneously with a primary charging,
2. a step for effecting a uniform exposure,
3. a step for carrying out a secondary charging in an opposite polarity to that of the primary charging, and
4. a step of effecting a uniform exposure.

EXAMPLE 1

In this embodiment the primary electrostatic latent image is formed on an insulating member of the photosensitive screen 20 shown in FIG. 6 according to the process A. The charge in the charging step which is simultaneously performed with the projection of light image, has positive polarity.

A method of manufacturing the photosensitive screen 20 used in this embodiment is firstly explained with reference to FIG. 6. As the conductive member or sheet 21 there is used a conductive mesh having #100–400 of metal such as stainless steel or the like. The conductive mesh is provided with an insulating member or layer 22 having a thickness of 10–30μ at its one major surface by spraying. As the insulating member 22 there is used organic resin having excellent insulating property such as polyurethane resin, polyvinyl chloride resin, acrylic resin, fluoroplastics, and epoxy resin. A photoconductive member 23c having a thickness of 10–50μ is formed by spraying onto another free major surface of the conductive mesh a mixture of 70% by weight of CdS powder having a particle size of about 0.5μ (made by General Electric Co.) and 30% by weight of a mixed solution of solution A and solution B of polyurethane resin, which is diluted with a mixed solution of methylcellosolve and toluene.

Figure 20A:
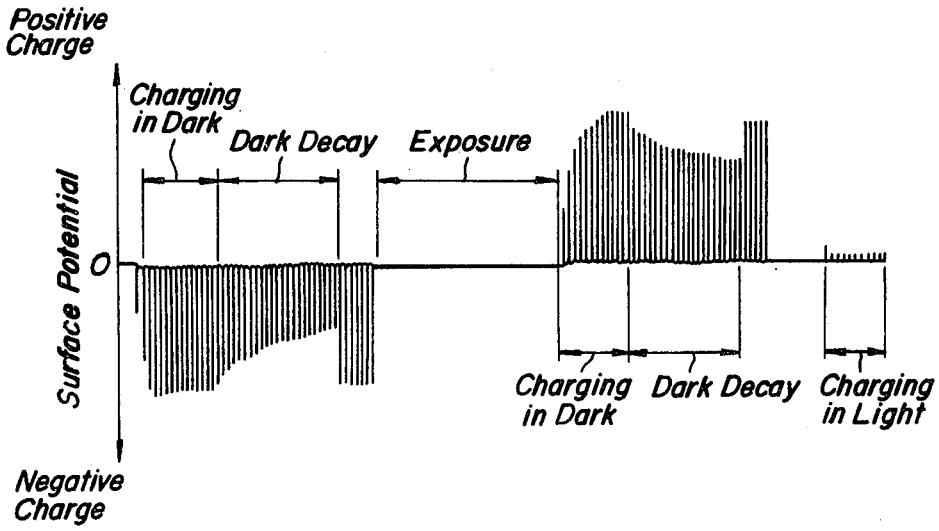
FIGS. 20*a* and 20*b* are graphs showing photosensitive and charging characteristics, respectively, of the photosensitive screen of FIG. 6.
Figure 20B:
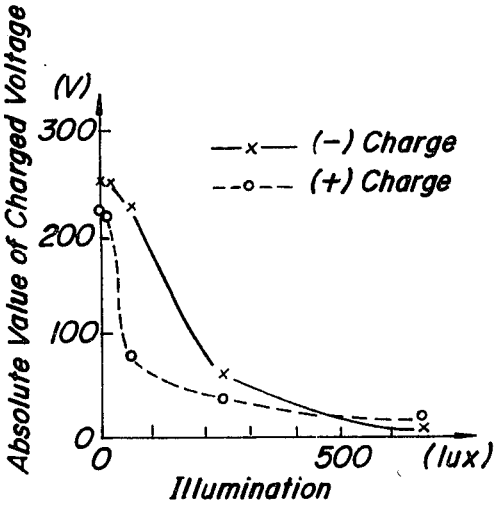

The photosensitive characteristic and the charging characteristic of the thus formed photosensitive screen are shown in FIGS. 20a and 20b, respectively. As shown in FIGS. 20a and 20b the photosensitive screen 20 has surface potential $V_{1D}$ of 200–300 V in absolute value by charging in dark and surface potential $V_{1L}$ of less than 50 V by charging in light (about 500 lux). The value of these surface potentials is different more or less by charging polarity.

Figure 21:
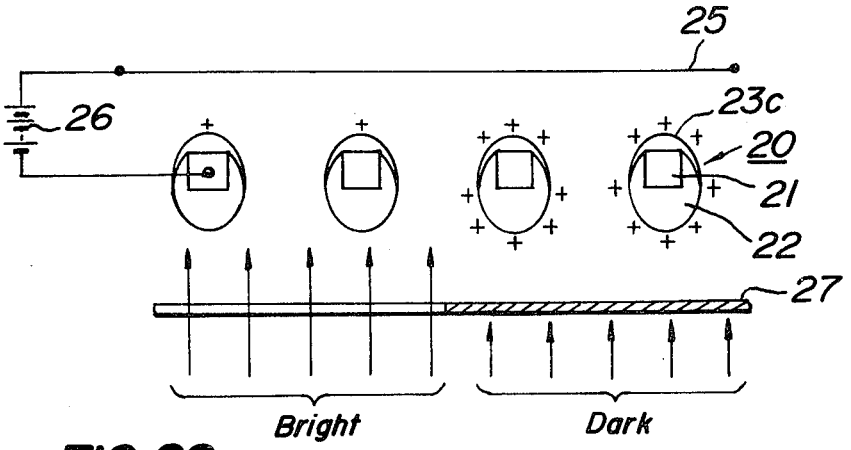
FIGS. 21, 22 and 23 are schematic diagrams for explaining the electrophotographic process according to the invention in which a process A is carried out for the screen shown in FIG. 6

FIG. 21 shows one embodiment of charging step for the screen 20, which step is simultaneously performed with projection of a light image. As shown in FIG. 21, a corona fine wire 25 is arranged at the side of the member 23c of the screen 20 and a corona D.C. supply source 26 is connected between the fine wire 25 and the member 21 of the screen 20 so as to apply a high voltage of positive polarity to the fine wire 25. A document 27 is arranged at the side of the insulating member 22 of the screen 20. In this arrangement when a light image of the document 27 is projected on the screen 20 and corona ions of positive polarity are applied to the screen 20 from the fine wire 25 the primary latent image according to the light image is formed on the insulating member 22 so that the portion of the member 23c corresponding to dark area of the light image is charged and the portion of the member 23c corresponding to bright part of the light image is also charge more or less. For the sake of simplicity, such areas of the screen 20 are sometimes referred as an imagewise dark area or a dark area and as an imagewise exposed or brightly exposed area or a bright area, respectively. If the imagewise exposure is performed from the side of the member 23c in the same manner as the corona charging, the amount of the charge on the photoconductive member 23c can be lessened for the bright area so that the contrast of the primary latent image may be improved.

Figure 22:
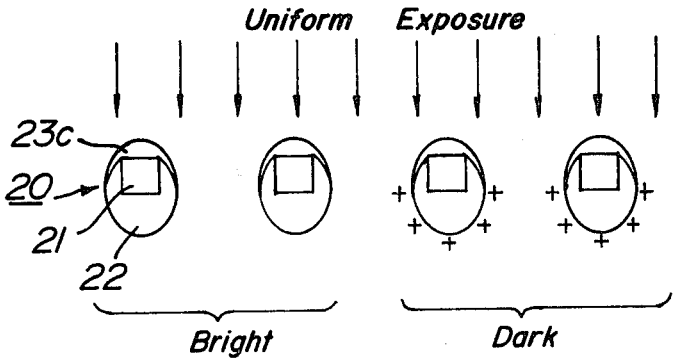

FIG. 22 shows a uniform exposure step of the photosensitive screen 20 which is performed subsequently to the light image projection and charging step. As described above, if the screen 20 is uniformly exposed from the side of the member 23c the charges formed on the member 23c in the previous charging step disappear and thus the primary latent image is only formed on the insulating member 22. The electrostatic contrast $V_c$ of the primary latent image thus formed may be expressed as follows.

$$V_c=(V_{1D}-V_{1L})$$

The uniform exposure may be effected from the side of the insulating member 22 or from both sides of the screeon 20.

Figure 23:
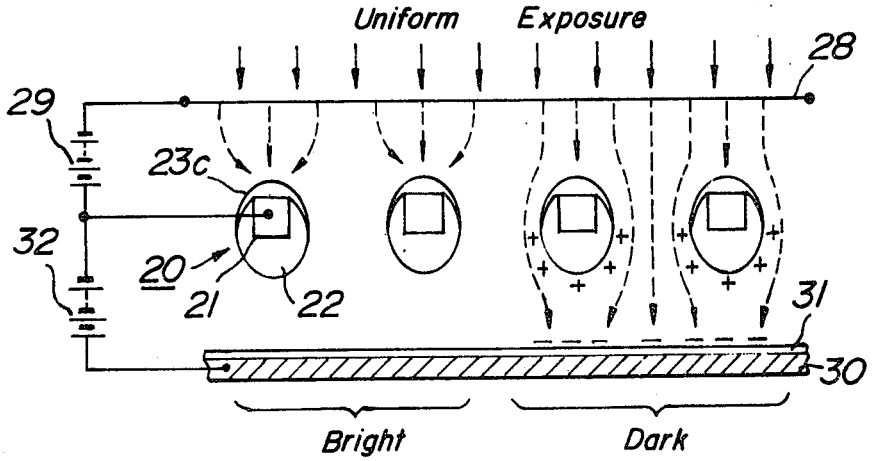

FIG. 23 shows one embodiment of a step in which the corona ion flow is modulated based on the thus formed primary latent image to form a secondary electrostatic latent image on a record medium. In this embodiment a corona fine wire 28 is arranged opposite to the member 23c of the screen 20 and a corona D.C. supply source 29 is connected between the fine wire 28 and the conductive member 21 of the screen 20 so as to apply a high voltage of polarity opposite to that of the charge in the charging step shown in FIG. 21, in this embodiment negative polarity, to the fine wire 28. A record member 31 which is placed on a counter electrode 30 is arranged opposite to the insulating member 22 of the photosensitive screen 20 on which the primary latent image has been formed. An acceleration supply source 32 is connected between the back electrode 30 and the conductive member 21 of the screen 20 so as to generate an electric field for accelerating a corona ion flow of negative polarity from the corona fine wire 28 to the counter electrode 30. In this embodiment the corona supply source 29 applies a voltage of −9 kV to the fine wire 28 and the acceleration supply source 32 applies a voltage of +4 kV to the counter electrode 30. A uniform exposure is then performed from the side of the member 23c and the negative corona ion flow is projected toward the record member 31 from the fine wire 28. At the portion of the screen 20 corresponding to the dark area of light image the corona ion flow passes through openings of the screen 20 and is attracted to the counter electrode 30 to charge the record member 31. At the portion of the screen 20 corresponding to the bright area of light image the corona ion stream is prevented from passing through the openings of screen 20 and flows into the conductive member 21 through the photoconductive member 23c. The secondary latent image corresponding to the primary latent image is then formed on the record member 31 by the corona ion flow which is modulated according to the primary latent image formed on the screen 20.

The secondary latent image formed on the record member 31 as described above is visualized by any known developing method, for example cascade developing method or liquid developing method and subjected to a fixing step resulting in a final copied image.

As the record member 31 there is generally used a low resistivity treated record paper having a high resistive organic resin layer coated thereon, but provided that at least the recording surface is made of high resistive material any record member can be used to form the secondary latent image. The contrast of the secondary latent image may be sometimes lessened due to the fact that the corona ion stream might slightly pass through the screen 20 even at the bright area thereof during the secondary latent image forming step. To prevent this lessening in contrast it is preferable that the recording surface of the record member 31 is previously charged to a uniform and low potential by the charges having polarity opposite to that of the corona ions forming the secondary latent image.

If the corona discharge forming the secondary latent image is an A.C. corona discharge generating the same amount of positive and negative corona ions, the undesired charging to the photoconductive member 23c can be prevented during the step shown in FIG. 23 so that uniform exposure is not necessary. If the A.C. discharge is performed in dark and an amount of generated corona ions having positive polarity is made larger than that of negative corona ions, the charges of positive polarity are deposited on the member 23c. If the charge potential has a value lower than the potential $V_{1D}$ at the dark area, but higher than the potential $V_{1L}$ in the bright area of the primary latent image formed on the screen 20, the secondary latent image can be formed with high contrast. In this case A.C. voltage or D.C. voltage may be applied to the counter electrode 30. In the case of applying an A.C. voltage it must be in opposite phase to that of the A.C. voltage applied to the A.C. corona fine wire. In the case of applying a D.C. voltage it must be used a voltage having polarity opposite to that of the corona ion flow to be modulated.

EXAMPLE 2

In this embodiment the primary latent image is formed on the insulating member 22 of the photosensitive screen 20 shown in FIG. 6 according to the process A. The charge in the charging step which is simultaneously performed with the projection of the light image in FIG. 21, has negative polarity. The electrostatic contrast $V_c$ of the primary latent image finally formed on the insulating layer 22 is shown as follows.

$$V_c = -(V_{1D} - V_{1L})$$

Also in this example, a primary latent image having high electrostatic contrast can be formed in the same manner as the example 1.

EXAMPLE 3

In this embodiment the primary latent image is formed on the insulating member 22 according to the process A by the use of the photosensitive screen 20 shown in FIG. 7. The charging step, which is simultaneously performed with the projection of the light image, must be effected in positive polarity since the photoconductive member 23*a* of the screen 20 has the a-type rectifying characteristic shown in FIG. 9*a*. The primary latent image having electrostatic contrast of $V_c = (V_{1D} - V_{1L})$ may then be formed on the insulating layer 22 in the same manner as the example 1. In this embodiment it is necessary to project a corona ion flow of negative polarity as shown in FIG. 23 during formation of the secondary latent image while the photoconductive member 23*a* is not susceptible of negative charge so that uniform exposure may be omitted.

EXAMPLE 4

In this embodiment the primary latent image is formed on the insulating member 22 of the photosensitive screen 20 shown in FIG. 8 according to the process A. The polarity of the charge in the charging step, which is simultaneously performed with the projection of the light image, must be made negative since the photoconductive member 23*b* of the screen 20 has the b-type rectifying characteristic shown in FIG. 9*b*.

The primary latent image having the electrostatic contrast of $V_c = -(V_{1D} - V_{1L})$ may then be formed on the insulating layer 22 in the same manner as the example 2. In this embodiment uniform exposure may be omitted during formation of the secondary latent image as in the example 3.

EXAMPLE 5

Figure 24:
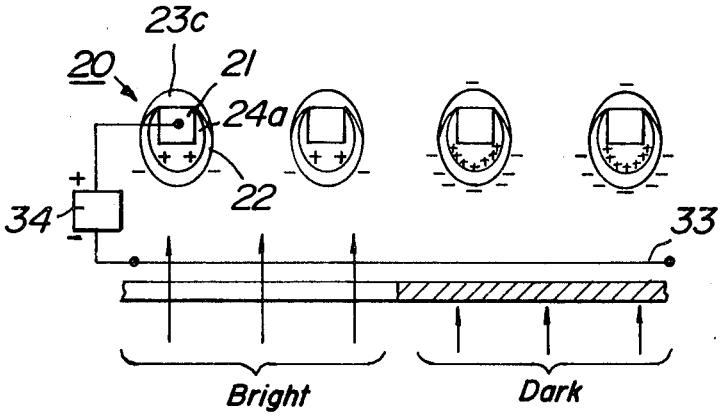
FIGS. 24, 25 and 26 are schematic views showing successive steps of the process A using the screen of FIG. 10.

In this embodiment the primary latent image is formed according to the process A on the insulating member 22 of the photosensitive screen 20 shown in FIG. 10. The charging step which is simultaneously performed with the projection of light image is performed with a negative polarity. As shown in FIG. 24, first a corona wire 33 is arranged at the side of the insulating member 22 of the photosensitive screen 20 and a D.C. corona supply source 34 is connected between the wire and the conductive member 21 of the screen 20 so as to apply a high voltage of negative polarity to the wire 33. The negative corona ion flow then is projected to the screen 20 from the wire 33 and at the same time the light image is projected to the screen 20 from the side of the member 22, so that the amounts of the charges trapped at the interface between the insulating member 22 and a second photoconductive member 24*a* in the dark area and the bright area of the light image, are different from each other, and thus the surface potential $V_{1D}$ of the insulating member 22 at the dark area is different from the surface potential $V_{1L}$ of the member 22 at the bright area. In the imagewise exposure and charging step shown in FIG. 24 the corona ion flow may be projected by arranging the corona fine wire 33 at the side of the first photoconductive member 23*c*.

Figure 25:
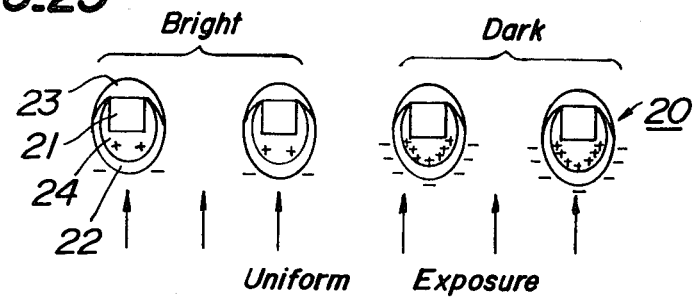

As shown in FIG. 25 the photosensitive screen 20 is then exposed uniformly. With such uniform exposure the charges stored on the first photoconducting member 23*c* disappear, so that the primary latent image is only formed on the insulating member 22. In this case the electrostatic contrast $V_c$ of the primary latent image is given as follows.

$$V_c = |V_{1D} - V_{1L}|$$

The uniform exposure in FIG. 25 may be performed from the side of the insulating member 22 and/or at the side of the photoconductive member 23*c*.

Figure 26:
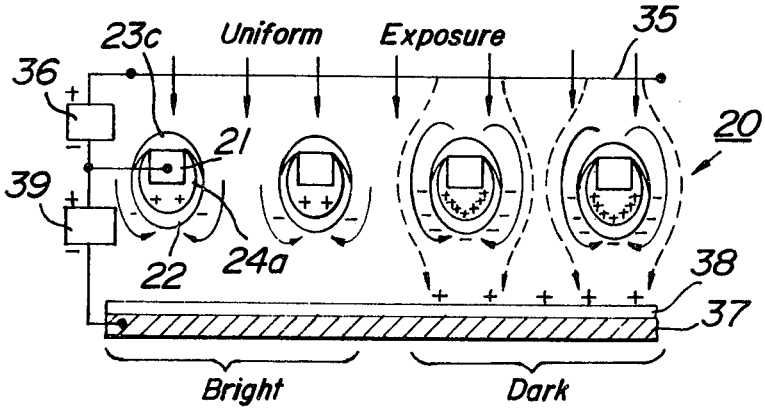

FIG. 26 shows one embodiment of the step of forming a secondary electrostatic latent image on the record medium based on the primary latent image formed as described above. In this embodiment a corona fine wire 35 is arranged at the side of the first photoconductive member 23*c* and a D.C. corona supply source 36 is connected between the wire 35 and the conductive member 21 of the screen 20 so as to apply a high voltage of a polarity opposite to that of the charge in the charging step shown in FIG. 24, in this embodiment, positive polarity to the fine wire 35. A record member 38 which is placed on a counter electrode 37 is arranged opposite to the insulating member 22 of the photosensitive screen 20 on which the primary latent image has been formed. An acceleration supply source 39 is connected across the counter electrode 37 and the conductive member 21 of the screen 20 so as to generate an electric field for leading a corona ion flow of positive polarity projected from the corona fine wire 35 to the counter electrode 37. In this embodiment the uniform exposure is performed at the side of the first photoconductive member 23*c* while the positive corona ion flow is projected to the record member 38 from the corona fine wire 35. In this case an electric field for promoting the positive corona ion flow is only generated at the apertures of the screen 20, and the field strength of the electric field is different at the bright area and at the dark area so that the corona ion flow projected from the wire 35 reaches the record member 38 regardless of the dark area and the bright area and thus a secondary latent image having a large amount of fog is formed. To prevent the formation of such fog it is necessary that the record medium 38 is previously charged to a constant potential of negative polarity (for example few tens volts~few hundreds volts).

EXAMPLE 6

In this embodiment the primary latent image is formed on the insulating member 22 according to the process A by the use of the photosensitive screen 20 shown in FIG. 10 in the same manner as the example 5. The charge in the charging step, which is simultaneously performed with the projection of the light image, has positive polarity. The electrostatic contrast $V_c$ of the primary latent image formed on the insulating member 22, in this embodiment, is expressed as follows.

$$V_c=\alpha_p V_{1D}-V_{1L}$$

When the electrostatic capacity of the second photoconductive layer 24 is $C_p$ and the electrostatic capacity of the insulating layer 22 is $C_i$, $\alpha_p$ can be denoted as follows.

$$\alpha_p=\frac{C_p}{C_p+C_i}$$

If the uniform exposure step is not effected after the light image projection and charging step the electrostatic contrast $V_c$ of the primary latent image is expressed as follows.

$$V_c=|V_{1D}-V_{1L}|$$

EXAMPLE 7

Figure 11:
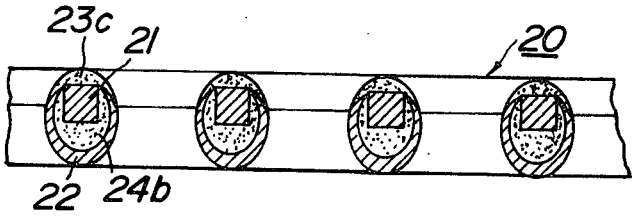

In this embodiment the primary latent image is formed according to the process A on the insulating member 22 of the photosensitive screen 20 shown in FIG. 11. The charge in the charging step which is simultaneously performed with the projection of the light image has positive polarity. In this embodiment the charge has the same polarity as that described in the example 6 so that the electrostatic contrast $V_c$ of the primary latent image is represented as follows:

$$V_c=V_{1D}-V_{1L}$$

EXAMPLE 8

In this embodiment the primary latent image is formed according to the process A on the insulating member 22 of the photosensitive screen 20 shown in FIG. 11 in the same manner as the example 7. The charging step, which is performed simultaneously with the projection of the light image, is effected in negative polarity. In this embodiment the charge has the same polarity as that described in the example 5 so that the electrostatic contrast $V_c$ of the primary latent image is given as follows.

$$V_c=-(\alpha_p V_{1D}-V_{1L})$$

EXAMPLE 9

Figure 12:
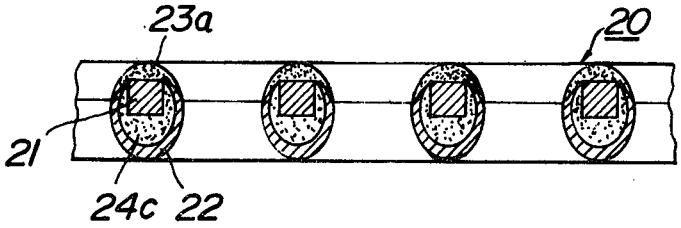

In this embodiment the primary latent image is formed on the insulating member 22 according to the process A by the use of the photosensitive screen 20 shown in FIG. 12. The polarity of the charge in the charging step, which is performed simultaneously with the projection of the light image, must be positive since the first photoconductive member **23*c* shown in FIG. 12 has the a-type rectifying characteristic shown in FIG. 9*a*. In this embodiment the primary latent image having electrostatic contrast of $V_c=(\alpha_p V_{1D}-V_{1L})$ can be formed as in the same manner as the example 6. It is necessary to project the negative corona ion flow to the screen 20 for forming the secondary latent image but this negative corona ion flow is not stored on the first photoconductive member 23*c*** so that the uniform exposure can be omitted in the formation of the secondary latent image.

EXAMPLE 10

Figure 13:
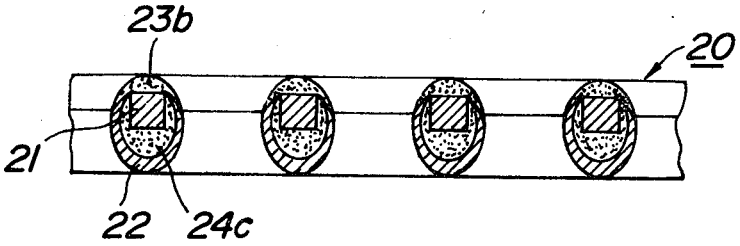

In this embodiment the primary latent image is formed on the insulating member 22 according to the process A by the use of the photosensitive screen 20 shown in FIG. 13. The polarity of the charge in the charging step, which is performed simultaneously with the projection of the light image, must be negative since the first photoconductive member **23*b* of the screen 20 has the b-type characteristic which is not susceptible of positive charging. In this embodiment then the primary latent image having electrostatic contrast as $V_c=-(\alpha_p V_{1D}-V_{1L})$ can be formed in the same manner as the example 8. It is necessary to project the corona ion flow of positive polarity to the screen 20 but this corona ion flow is not stored on the first photoconductive member 23*b*** so that the uniform exposure can be omitted in the formation of the secondary latent image as in the example 9.

EXAMPLE 11

Figure 14:
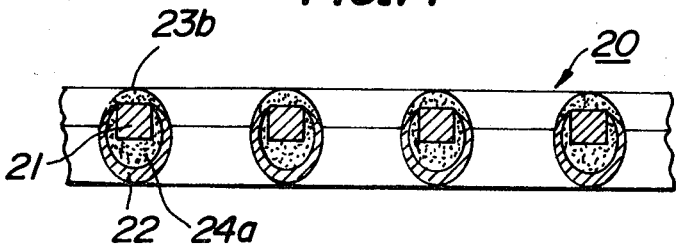

In this embodiment the primary latent image is formed on the insulating member 22 of the photosensitive screen 20 shown in FIG. 14 according to the process A. The first photoconductive member **23*b* of the screen 20 has the b-type rectifying characteristic shown in FIG. 9*b* and the second photoconductive member 24*a* has the a-type rectifying characteristic shown in FIG. 9*a*** so that the primary latent image having electrostatic contrast as $V_c=-(V_{1D}-V_{1L})$ can be formed in the same manner as the example 5. In this embodiment the uniform exposure can be omitted in the formation of the secondary latent image.

EXAMPLE 12

Figure 15:
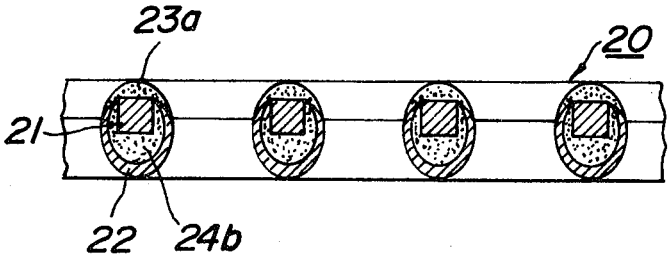

In this embodiment the primary latent image is formed on the insulating layer 22 of the photosensitive screen 20 shown in FIG. 15 according to the process A. The first photoconductive member **23*a* has the a-type rectifying characteristic and the second photoconductive member 24*b*** has the b-type rectifying characteristic so that the primary latent image having electrostatic contrast as $V_c=(V_{1D}-V_{1L})$ can be formed in the same manner as the example 7. In this embodiment the uniform exposure can be omitted during the formation of the secondary latent image.

EXAMPLE 13

Figure 27:
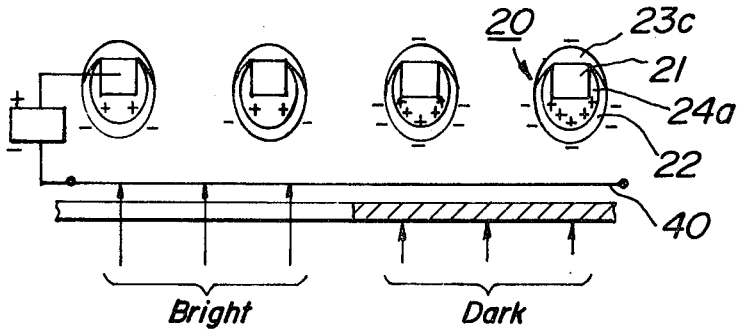
FIGS. 27, 28, 29 and 30 are schematic diagrams showing the successive steps of a process B using the screen of FIG. 10

In this example the primary electrostatic charge latent image is to be formed on the photosensitive screen 20 illustrated in FIG. 10 by means of the process B. The screen 20 comprises the first photoconductive layer **23*c* of c-type and thus either positive and negative charge may be applied thereon. In this example the primary charging step which is effected simultaneously with the imagewise exposure is carried out in the negative polarity. As shown in FIG. 27 a corona wire 40 is arranged opposite to the insulating member 22 and a D.C. corona supply voltage source 41 is connected across the corona wire and the conductive member 21 of the screen 20 so as to apply a negative high voltage to the corona wire 40. From the wire 40 a negative corona ion stream is projected toward the screen 20 and at the same time a light image corresponding to a document to be copied is projected from the side of the insulating layer 22. During this imagewise exposure a part of the first photoconductive layer 23c which corresponds to a bright area of the image becomes conductive, but the remaining part of the layer 23c corresponding to a dark area of the image still has high resistance. Thus after sufficient electrification the absolute value of the surface potential $V_{1D}$ of the imagewise dark portion of the screen 20 becomes larger than that of the surface potential $V_{1L}$ of the imagewise exposed portion. In this imagewise exposure and primary electrification step the corona wire 40 may be arranged opposite to the first photoconductive layer 23c**.

Figure 28:
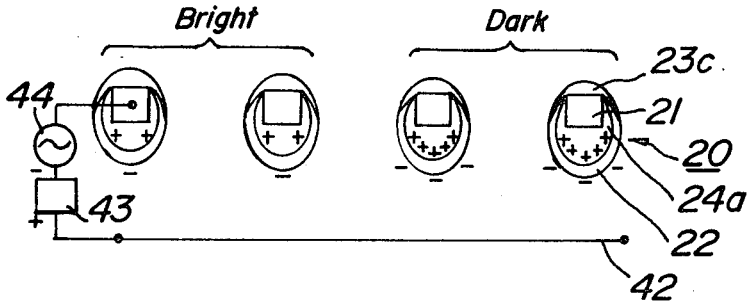

Next the screen 20 is charged in opposite polarity to that of the primary charging and the surface potentials at the imagewise dark and exposed areas are made apparently equal to each other. To this end as illustrated in FIG. 28 a corona wire 42 is provided opposite to the insulating layer and a D.C. supply source 43 and an A.C. supply source 44 are connected in series across the wire 42 and the conductive sheet 21 of the screen 20 so as to apply a positive D.C. voltage having an A.C. voltage superimposed thereon to the wire. It should be noted that during this secondary electrification step it is sufficient to effect the electrification in the polarity opposite to that of the primary charging and thus the A.C. supply source 44 may be dispensed with and further an amount of D.C. or A.C. charge may be controlled by a control grid arranged between the corona wire 42 and the screen 20.

Figure 29:
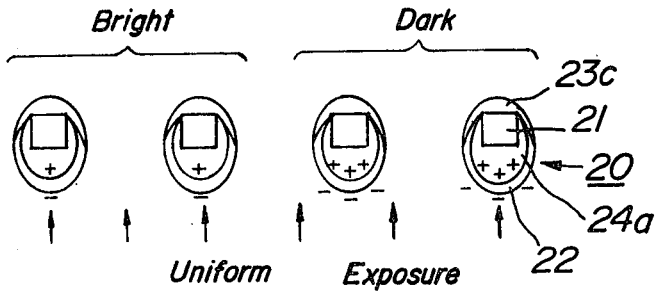

After the secondary electrification has been completed the screen 20 is subjected to a uniform exposure as depicted in FIG. 29. As a result the surface potentials at the exposed and dark areas have different values in accordance with a difference in amount of charges trapped in the boundary between the second photoconductive layer 24a and the insulating layer 22. Then the electrostatic contrast Vc of the primary latent image thus formed on the insulating layer 22 can be expressed as follows:

$$V_c = -\alpha_i(V_{1D} - V_{1L})$$

$$\text{wherein } \alpha_i = \frac{C_i}{C_p + C_i}$$

In this example, since the absolute value of the surface potential $V_{1D}$ at the dark portion during the primary electrification step can be made large, it is possible to form the primary latent image having a very high electrostatic contrast. In FIG. 29 the uniform exposure is effected from the side of the insulating layer 22, but it may be done from the side of the first photoconductive layer 23c or from both sides.

Figure 30:
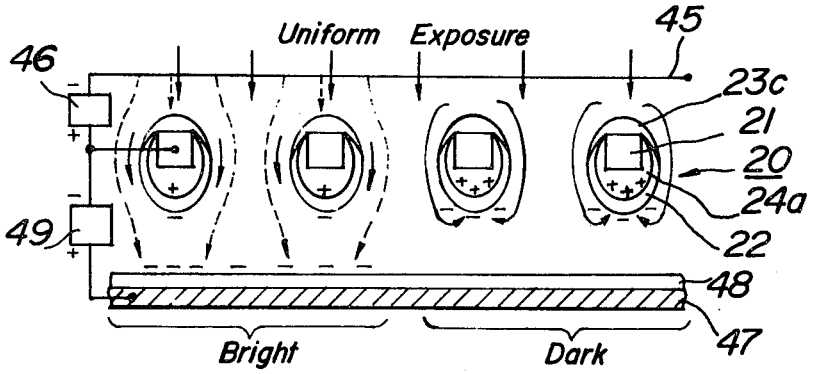

FIG. 30 illustrates a manner of forming a secondary latent image on a record medium with the aid of the primary latent image formed on the insulating layer 22 in the manner explained above. A corona wire 45 is arranged above the first photoconductive layer 23c and a D.C. corona supply voltage source 46 is connected across the wire and the conductive sheet 21 of the screen so as to apply a negative high voltage to the wire, this polarity being same as that of the primary charging step. Opposite to the insulating layer 22 is arranged a record member 48 placed on a back electrode 47 and an accelerating voltage source 49 is connected across the conductive member 21 and the back electrode 47. Then a negative corona ion stream is projected from the corona wire 45 toward the screen 20 and the record member 48 while the screen is subjected to a uniform exposure from the side of the first photoconductive layer 23c. Around the fine apertures of the screen there are produced an accelerating electric field having the same direction, but different strengths in accordance with the surface potentials. Therefore in order to form the secondary latent image on the record member 48, the record member 48 should have been charged in positive polarity to a given potential. However by suitably selecting the potential during the secondary charging step shown in FIG. 28, it is possible to form the enhancing field at the dark area and the blocking field at the exposed area and in such a case it is not necessary to previously charge the record member 48. Further if the corona discharge in FIG. 30 is effected with the D.C. voltage having an A.C. voltage superimposed thereon, the uniform exposure step may be omitted.

If the primary electrification is effected in a polarity opposite to that mentioned above, the secondary charging must be done in negative polarity and thus it is theoretically impossible to form the primary latent image. However in practice, even in this case since charging and discharging rates are different between the bright and dark areas, it may be possible to form the primary latent image in a transient situation.

EXAMPLE 14

In this example the primary latent image is formed on the screen 20 shown in FIG. 11 by adopting the process B. The polarities of primary and secondary electrification steps are opposite to those of the example 13.

Thus the electrostatic contrast $V_c$ of the primary latent image formed on the insulating layer 22 of screen 20 can be expressed as follows:

$$V_c = \alpha_i(V_{1D} - V_{1L})$$

EXAMPLE 15

Figure 31:
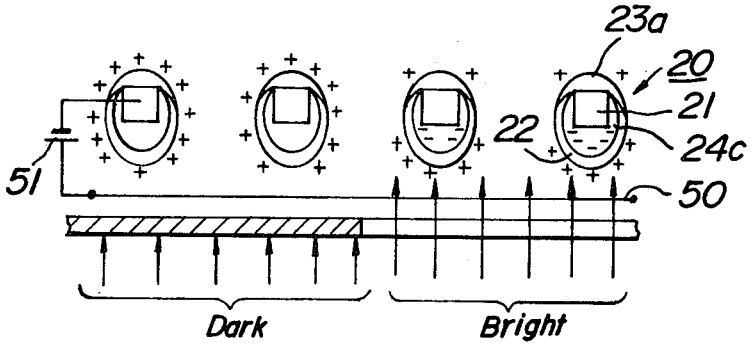
FIGS. 31, 32 and 33 are schematic views showing the electrophotographic process according to the invention in which the process B is carried out using the screen of FIG. 12.

In this example use is made of the photosensitive screen 20 shown in FIG. 12 and the primary latent image is formed on the insulating layer 22 in accordance with the process B. The polarity of the primary electrification is selected to be positive. At first as shown in FIG. 31 a corona wire 50 is placed opposite to the insulating layer 22 of screen 20 and a corona supply voltage source 51 is connected across the wire and the conductive sheet 21 of screen 20 so as to apply a positive high voltage to the wire 50. The wire projects a positive corona ion stream toward the screen and at the same time the screen is subjected to an imagewise exposure. Since the first photoconductive layer 23a has the a-type rectification property positive charges are applied on the first photoconductive layer 23a at the dark portion of the screen 20, but no negative charge is trapped at the boundary between the second photoconductive layer 24c and the insulating layer 22. While the brightly exposed area of the second photoconductive layer 24c is illuminated by light, negative ions are injected into and trapped at the boundary of the second photoconductive layer 24c and insulating layer 22. It should be noted that the bright area of the first photoconductive layer 23a has positive charges more or less.

Figure 32:
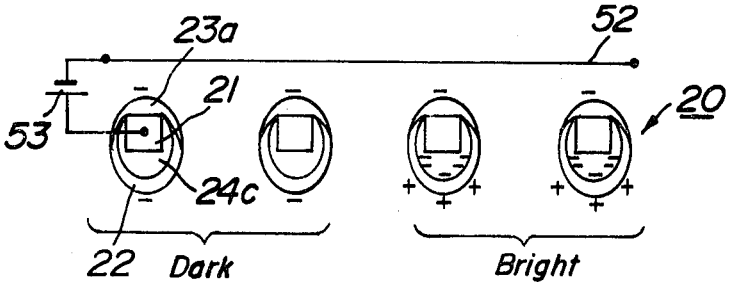

Next the screen 20 is subjected to the secondary reverse polarity electrification as illustrated in FIG. 32. In front of the first photoconductive layer 23a is arranged a corona wire 52 and a corona supply source 53 is connected across the wire and the conductive sheet 21 so as to apply a voltage thereacross in opposite polarity to that of the primary electrification step. The reason for effecting the electrification from the side of the first photoconductive layer 23a is that it is hardly charged in the negative polarity and thus serves as a control grid. In this manner the surface potential of the screen 20 can be apparently made uniform. It is matter of course that the secondary electrification may be done from the side of the insulating layer 22 by means of an A.C. corona discharger. In this case the charge potential may be controlled by arranging the control grid between the corona wire and screen. During the secondary charging step the charges trapped in the boundary between the second photoconductive layer 24c and the insulating layer 22 cannot move and remain unchanged. If the surface potential of the whole screen 20 becomes zero during the secondary charging step, there exist the charges in the boundary between the insulating layer 22 and the second photoconductive layer 24c and on the free surface of the insulating layer at the bright portion of the screen and these charges are balanced electrostatically with each other.

Figure 33:
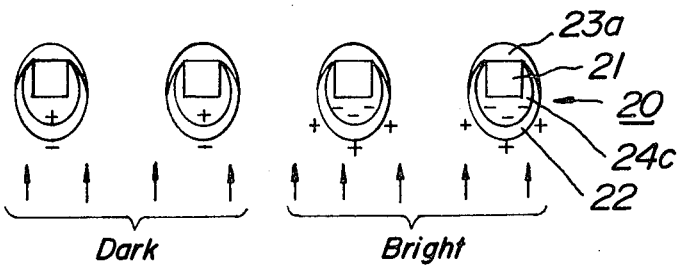

FIG. 33 shows the uniform exposure step which is effected next to the secondary charging step. In FIG. 33 the exposure is effected from the side of the insulating layer 22, but this may be done from the side of the first photoconductive layer 23a or from both sides. Upon the uniform exposure, the charges trapped in the boundary between the second photoconductive layer 24c and the insulating layer 22 at the imagewise exposed area are released and are balanced electrostatically by the charges on the insulating layer so as to form the primary latent image. The electrostatic contrast $V_c$ of this primary latent image can be represented as follows:

$$V_c = -\alpha_i V_{1L}$$

The potential at the dark area is lower than that at the bright area and thus the primary latent image is of a negative nature with respect to the optical image. But it is also possible to form the primary latent image of a positive nature by suitably selecting the charge potential at the secondary reverse polarity electrification step.

From the primary latent image thus formed the secondary latent image may be formed on the record member in the same manner as that explained with reference to FIG. 30. That is to say when a negative corona ion stream is projected from the corona wire 45 toward the screen 20, the secondary latent image of a negative nature with respect to the light image is formed on the record medium and when the positive corona ion stream is generated, the secondary latent image of a positive image can be formed. In case of using the negative corona ion stream the uniform exposure may be omitted. In this manner by suitably choosing the charge potential during the secondary charging step and the polarity of the corona ion stream for forming the secondary latent image the primary and secondary latent images can be formed as any combinations of positive-positive, positive-negative, negative-positive and negative-negative.

Figure 34:
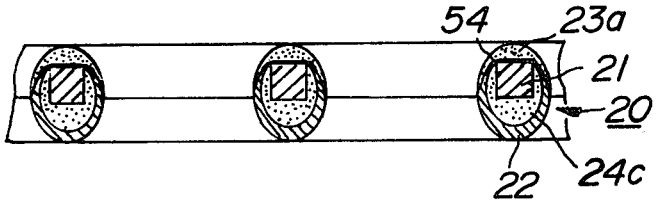
FIG. 34 is a cross section showing another embodiment of the photosensitive screen according to the invention.

As explained above, the electrostatic contrast $V_c$ of the primary latent image is determined by the surface potential $V_{1L}$ of the screen 20 corresponding to the bright area of the image in the imagewise exposure and primary charging step shown in FIG. 31. Therefore when an opaque conductive layer 54 is formed by evaporation under the first photoconductive layer 23a as illustrated in FIG. 34, the first photoconductive layer 23a is not illiminated and thus the insulating layer 22 can be charged in the primary electrification step to a sufficiently high potential, which results in the higher electrostatic contrast.

EXAMPLE 16

In this example the polarities of the primary and secondary electrification steps are made opposite to those in the example 15. Thus the electrostatic contrast $V_c$ of the primary latent image formed on the screen 20 can be expressed by the following equation.

$$V_c = \alpha_i V_{1L}$$

EXAMPLE 17

In this example the primary latent image is formed on the screen 20 illustrated in FIG. 13 by means of the process B. The primary charging is effected in the positive polarity. Thus this example is similar to the example 15 and the electrostatic contrast $V_c$ of the primary electrostatic charge latent image formed on the insulating layer 22 is given by the following equation:

$$V_c = -\alpha_i V_{1L}$$

EXAMPLE 18

This example is same as the previous example 17 except the polarities of the primary and secondary charging steps. The electrostatic contrast $V_c$ of the primary charge latent image is expressed as follows:

$$V_c = \alpha_i V_{1L}$$

EXAMPLE 19

Figure 35:
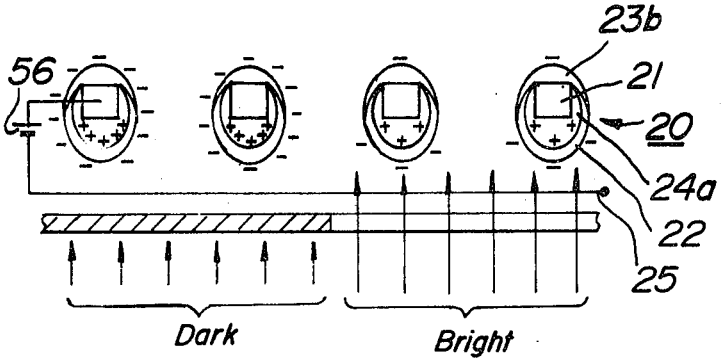
FIGS. 35, 36, 37 and 38 are schematic views showing successive steps of the process B according to the invention while using the screen shown in FIG. 14.

In this example use is made of the photosensitive screen 20 shown in FIG. 14 and the primary latent image is formed on the insulating layer 22 in accordance with the process B. As illustrated in FIG. 35 a corona wire 55 is provided in front of the insulating layer 22 of screen 20 and a corona supply voltage source 56 is connected across the wire and conductive sheet 21 so as to project a negative corona ion stream from the wire to the screen and at the same time an imagewise exposure is effected from the insulating layer side. Since the first photoconductive layer 23b is of b-type and can be charged efficiently with negative charges, the first photoconductive layer 23b and insulating layer 22 at the dark area of the imagewise exposure has a potential $V_{1L}$. Then positive charges are injected into the second photoconductive layer 24a and are trapped in the boundary between the insulating layer 22 and second photoconductive layer 24a, while at the brightly exposed area, due to the effect of light passing through the insulating layer 22, the first photoconductive layer 23b becomes locally conductive and an amount of charges trapped in the boundary between the second photoconductive layer 24a and insulating layer 22 becomes smaller as compared with that at the dark area. Thus the surface potential $V_{1L}$ at the bright area of the screen 20 becomes lower than the potential $V_{1D}$ at the dark area.

Figure 36:
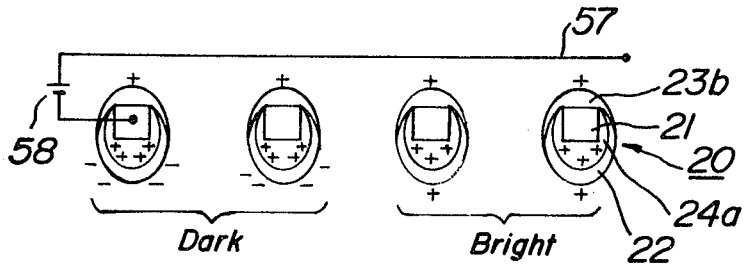

Next the secondary reverse polarity charging step is carried out as shown in FIG. 36. To this end a corona wire 57 is arranged at the first photoconductive layer side and a corona supply voltage source 58 is connected across the wire 57 and the conductive member 21 so as to effect the secondary charging step in polarity opposite to that of the primary charging step. Since the first photoconductive layer 23*b* is of b-type and is hardly charged in the positive polarity the secondary charging must be performed from the side of the first photoconductive layer 23*b*. Therefore the surface potential of the whole screen 20 can be controlled by the surface potential (positive saturation potential) on the first photoconductive layer 23*b*, and thus the whole surface of screen 20 can have zero voltage. It should be noted that the charge potential may be controlled by effecting the electrification by means of an A.C. corona charger or by providing a control grid between the corona wire and the screen 20. During the secondary charging step the charges trapped in the boundary between the second photoconductive layer 24*a* and insulating layer 22 during the imagewise exposure and primary charging step do not scarcely move, and thus the whole surface of the screen 20 has apparently a given constant potential.

Figure 37:
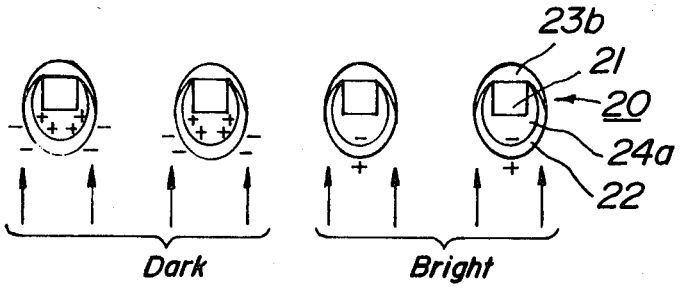

FIG. 37 illustrates the uniform exposure step which is effected next to the secondary charging step. In FIG. 37 the exposure is effected from the insulating layer side, but it may be done from the opposite side or both sides of the screen 20. This uniform exposure step is to release the charges which have been trapped in the boundary of layers 24*a* and 22. On the insulating layer 22 there are negative charges at the imagewise dark area and positive charges at the imagewise brightly exposed area and these charges are balanced with charges of opposite polarities at the boundary. Therefore on the insulating layer 22 there is formed the primary latent image consisting of positive and negative charges, and the electrostatic contrast $V_c$ of this primary latent image can be expressed as follows:

$$V_c = -\alpha_i(V_{1D} - V_{1L})$$

Figure 38:
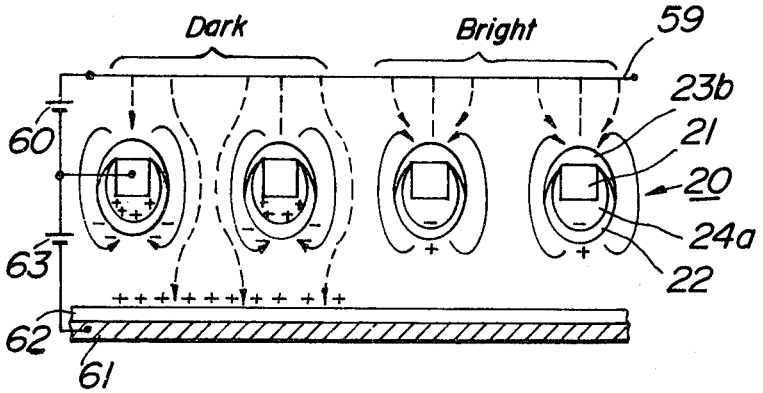

FIG. 38 shows the secondary latent image forming step on the basis of the primary latent image formed on the insulating layer in the manner explained above. In FIG. 38 a corona wire 59 is arranged in front of the first photoconductive layer 23*b* and a corona supply voltage source 60 is connected across the wire 59 and the conductive member 21 of screen 20 so as to apply a positive high voltage (6~10 KV) to the wire 59. A record member 62 is placed on a back electrode 61 arranged opposite to the insulating layer 22 and an accelerating voltage source 63 is connected across the electrode 61 and the conductive sheet 21 so as to apply a negative voltage (−5.5~−4 KV) to the back electrode 61. The distance between the screen 20 and the electrode 61 is about 4 mm. In this manner a positive corona ion stream is projected from the wire 59 toward the record medium 62. At the imagewise dark area of the screen 20 the accelerating field is produced and thus the corona ion stream passes through the apertures of the screen and reaches the record medium 62. On the other hand, at the bright area the surface potential on the insulating layer 22 produces a positive voltage (preferably 50 to 130 V) in proportion to the charge potential produced by the secondary reverse polarity charging step and in the apertures there is formed a blocking field for preventing the positive corona ion stream from passing therethrough. Therefore on the record member 62 there is formed the positive secondary latent image of positive nature.

In this example the uniform exposure is not necessary for the secondary charge image forming step shown in FIG. 38. If it is required to form the secondary image of negative nature it is sufficient to reverse the polarities of the corona supply voltage source 60 and accelerating supply voltage source 63. In such a case it is necessary to effect the secondary latent image forming step under the uniform exposure.

EXAMPLE 20

In this example the primary electrostatic charge latent image is to be formed in the screen 20 illustrated in FIG. 15 with the aid of the process B. This example is the same as the last mentioned example 19 except that the polarities of the primary and secondary electrification steps are made opposite to those of the example 19. Thus the electrostatic contrast $V_c$ of the primary latent image is given by the following equation:

$$V_c = \alpha_i(V_{1D} - V_{1L})$$

It should be noted that since the first photoconductive layer 23*a* is of a-type, the uniform exposure has to be effected during the formation of the secondary charge image on the record medium.

EXAMPLE 21

Figure 39:
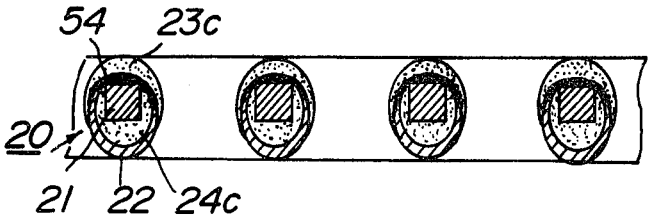
FIG. 39 is a cross section illustrating still another embodiment of the screen according to the invention.
Figure 40:
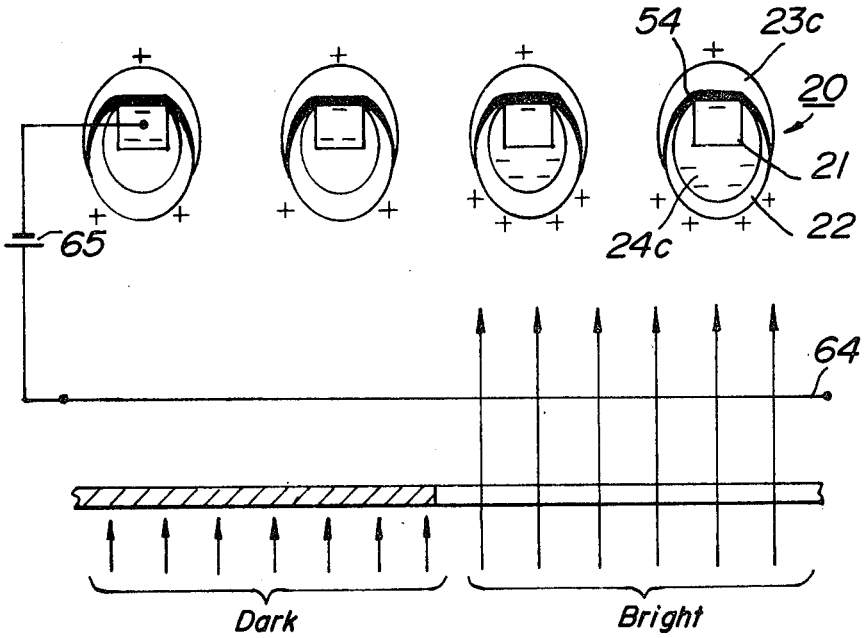
FIGS. 40, 41, 42 and 43 are schematic diagrams showing successive steps of the process B according to the invention while using the screen illustrated in FIG. 39.

In this example use is made of a photosensitive screen 20 shown in FIG. 39 and the primary latent image is formed on an insulating layer 22 using the process B. The screen 20 of FIG. 39 comprises an opaque conductive layer 54 under a first photoconductive layer 23*c* and thus has a similar construction to that of FIG. 16. FIG. 40 illustrates the imagewise exposure and primary charging step from the side of the insulating layer 22 by means of a corona wire 64 and a D.C. corona supply voltage source 65 connected across the wire and a conductive member 21 of the screen. A positive corona ion stream is projected onto the screen 20. At the same time the screen is subjected to the imagewise exposure from the insulating layer side. Then the imagewise exposed and dark areas of the screen are charged to surface potentials $V_{1L}$ and $V_{1D}$, respectively. These potentials are substantially equal to each other. However since at the bright area the second photoconductive layer 24*c* is illuminated by light there is substantially no potential produced across this layer 24*c* and thus the charges are electrified on the insulating layer 22. Then at the boundary between the second photoconductive layer and insulating layer negative charges are trapped, these charges having opposite polarity to that of the charges on the insulating layer 22. Since the opaque conductive layer 54 is under the first photoconductive layer 23*c*, the positive charges are electrified on this layer 23*c* both at the dark and exposed areas. In this manner the surface potential on the whole screen 20 becomes substantially uniform and moreover becomes very high.

Figure 41:
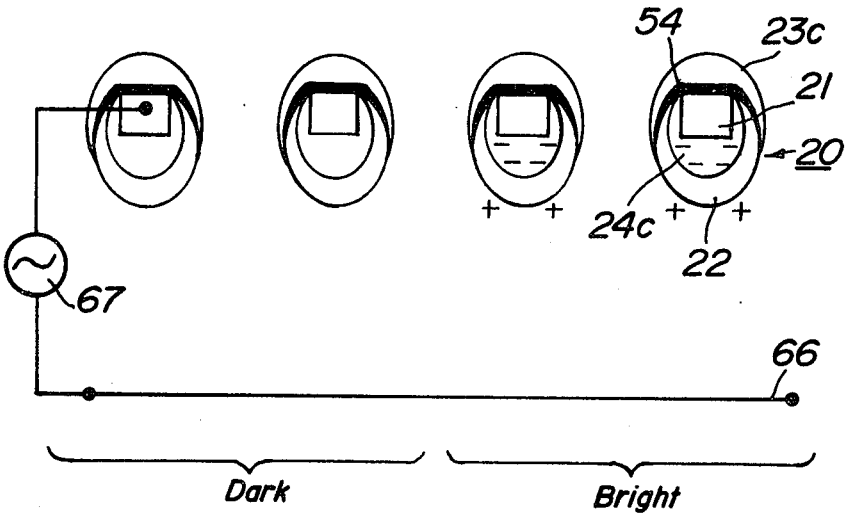

FIG. 41 shows the secondary reverse polarity electrification step following the above mentioned step. In the present example this secondary charging is effected with the aid of A.C. corona. To this end an A.C. corona supply voltage source 67 is arranged across a corona wire 66 and the conductive sheet 21. In practice the A.C. corona produces more or less larger amounts of negative corona ions than positive corona ions and thus a small amount of negative ions is applied to the screen, but for the sake of simplicity it is assumed that the amounts of positive and negative corona ions are equal to each other and thus negative charges do not remain on the screen. By effecting the electrification with such A.C. corona, the surface potential on the screen 20 becomes the same potential (0 V) as the conductive member 21 of the screen. It should be noted that the negative charges which have been trapped at the boundary between the second photoconductive layer 24c and insulating layer 22 at the imagewise exposed area during the primary charging and imagewise exposure step are not released by the secondary electrification step and thus all of the positive charges on the surface of insulating layer 22 are not necessarily cancelled in order to make the surface potential of the screen zero volt viewed from the insulating layer 22.

Figure 42:
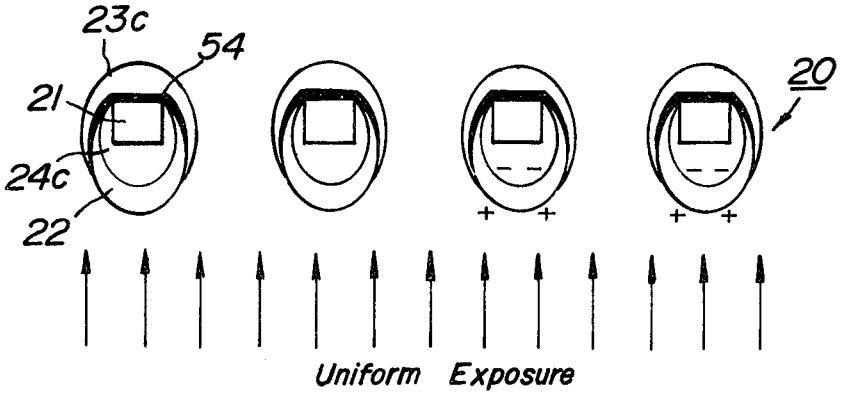

FIG. 42 shows the uniform exposure step. As explained above the surface potential on the whole screen 20 is apparently made zero volts in the secondary reverse polarity charging step, but when the uniform exposure is effected, the charges on the insulating layer 22 at the imagewise exposed area are balanced so as to produce a voltage.

By means of the above mentioned three successive steps the primary latent image of negative nature can be formed on the insulating layer 22 of screen 20 and its electrostatic contrast $V_c$ is expressed as follows:

$$V_c = -\alpha_i V_{1L}.$$

Figure 43:
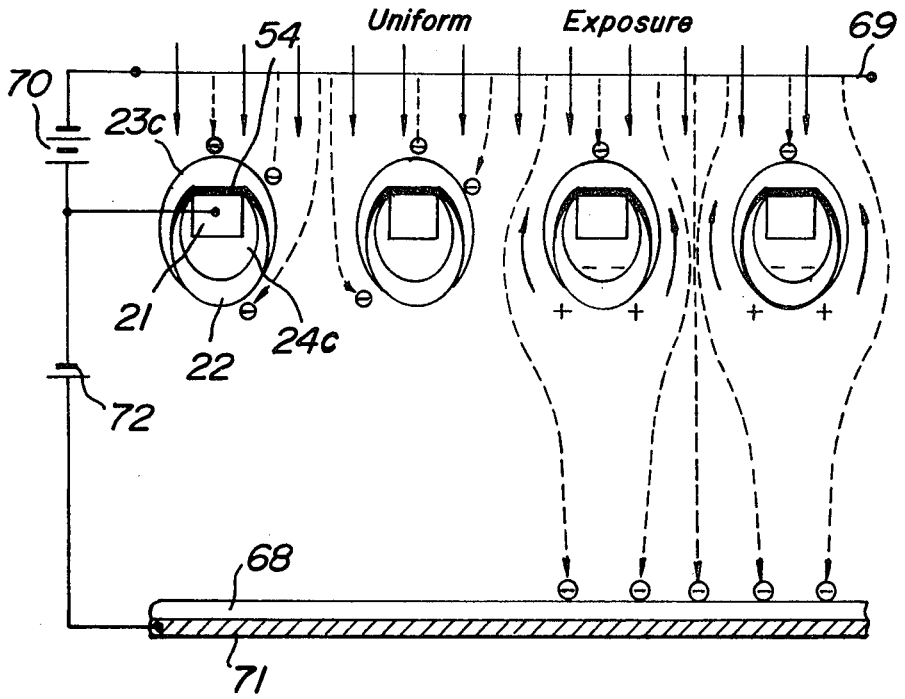

Now the step for forming the secondary charge latent image on the record medium such as a record paper, transfer medium and the like by modulating the corona ion stream in accordance with the primary latent image will be explained with reference to FIG. 43. While a uniform exposure is effected from the side of the first photoconductive layer 23c, a D.C. corona ion stream is projected toward a record member 68 through the screen 20. For this purpose a D.C. corona supply voltage source 70 is coupled across the conductive member 21 and a corona wire 69 so as to produce negative corona ions and an accelerating supply source 72 is connected across the conductive member 21 and a back electrode 71 so as to accelerate corona ions which have passed through the screen 20. At the imagewise exposed area there is generated the field for enhancing the passage of corona ion stream through the apertures of the screen and thus the negative corona ions pass through the screen and reach the record medium 68. On the other hand, at the imagewise dark area since such an enhancing field is not generated the corona ions do not pass through the screen, but extinguish via the first photoconductive layer 23 and conductive member 21. In this manner there is formed on the record medium 68 a negative secondary latent image of negative nature with respect to the exposed light image. Such a secondary latent image may be visualized by means of positive toners.

As already explained with reference to FIG. 41 when the A.C. corona is used for the secondary reverse polarity charging step negative charges are applied more or less at the imagewise dark area of the screen. However this does not affect the operation because the above negative charges produce an electric field having such a direction that prevents the passage of the negative corona ion stream through the apertures of the screen and can avoid a generation of fog in the dark area of the duplicated image of negative nature and thus duplicated copies of high quality can be formed. Furthermore, since the first photoconductive layer 23c is subjected to the uniform exposure during the secondary latent image forming step shown in FIG. 43, the layer 23c is not electrified with charges which might affect the formation of the secondary latent image.

Figure 44:
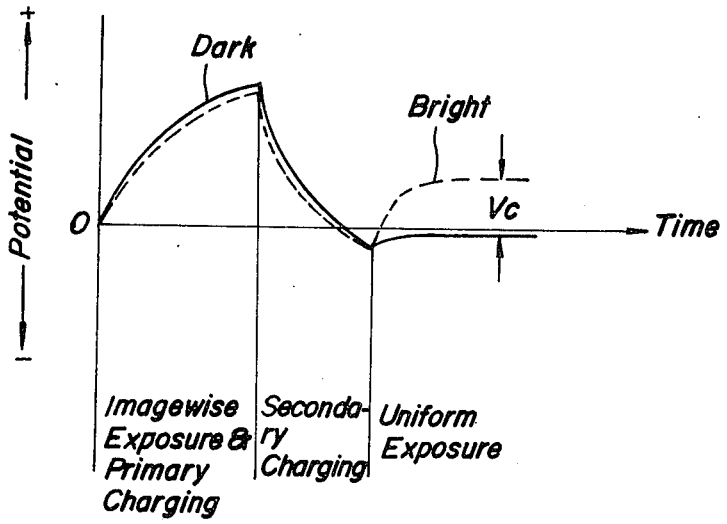
FIG. 44 is a graph showing a change in the surface potential of the screen at the successive steps depicted in FIGS. 40, 41, 42 and 43.

FIG. 44 is a graph showing the variation of surface potential on the screen 20 under the successive steps. In this graph the solid line represents the surface potential at the imagewise dark area and the dashed line that at the imagewise brightly exposed area. The electrostatic contrast $V_c$ of the primary latent image can be given by $$V_c = -\alpha_i V_{1L}$$

and the surface potential $V_{1L}$ at the imagewise exposed area can be made very high during the primary charging step. Therefore the electrostatic contrast of the secondary latent image can also be made high. Further the surface potential at the imagewise dark area of the screen after the secondary charging step is somewhat negative due to the unbalance property of the A.C. corona as explained above.

In the above explanation the secondary latent image of negative nature is formed from the primary latent image of negative nature. It is also possible to form the secondary latent image of positive nature from the primary latent image of positive nature. In this case a control grid for controlling the charge potential during the secondary electrification step shown in FIG. 41 is arranged between the screen 20 and the corona wire 30 so as to charge the screen in negative polarity to a suitable potential for forming the primary latent image of positive nature. In such a case the secondary charge image of positive nature may be formed on the record medium 68 by projecting the positive corona ion stream during the secondary latent image forming step.

EXAMPLE 22

This example is identical with the last example 21 except for that the primary charging is effected in the negative polarity. In this example there may be obtained the primary latent image consisting of negative charges and having the negative nature with respect to the light image, and the electrostatic contrast $V_c$ can be expressed by $V_c = \alpha_i V_{1L}$. From such a primary latent image the positive secondary charge image of a corresponding nature may be obtained. Also in this example it is possible to form the primary latent image of a positive nature by suitably effecting the secondary reverse polarity electrification step.

EXAMPLE 23

Figure 45:
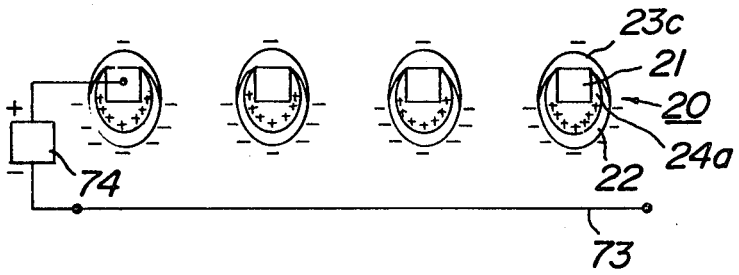
FIGS. 45, 46 and 47 are schematic views representing successive steps of a process C according to the invention while using the screen shown in FIG. 10 and FIG. 45 denotes a primary charging step, FIG. 46 an imagewise exposure and secondary opposite polarity charging step

In this example the photosensitive screen 20 shown in FIG. 10 is used and the primary electrostatic latent image is formed on the insulating member 22 of the screen 20 in accordance with the process C. To this end, as shown in FIG. 45 the primary electrification step is effected, in which a corona supply voltage source 73 is connected between a corona wire 73 arranged opposite to the insulating member 22 and the electrically conductive member 21 of screen 20 to produce a flow of negative corona ions from the corona wire 73 and to electrify the screen 20 uniformly. It is obvious that the primary electrification may also be performed from the side of the photoconductive member 23c. During the primary electrification, since the second photoconductive layer 23c of c-type, positive charges are trapped in the boundary between the second photoconductive member 24a and the insulating member 22 in accordance with the negative charges on the insulating member 22.

Figure 46:
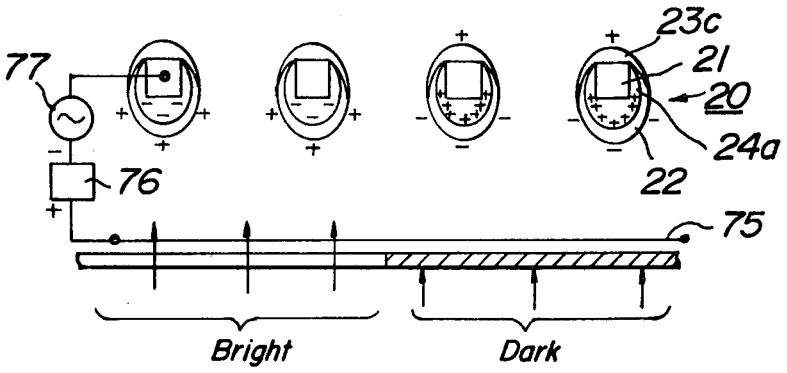

After the primary electrification step has been completed, the secondary electrification step having the opposite polarity to that of the primary electrification is effected simultaneous with the imagewise exposure. To this end, as shown in FIG. 46, a corona wire 75 is arranged opposite to the insulating member 22 and a D.C. supply source 76 and an A.C. supply source 77 are connected in series between the corona wire 75 and the conductive member 21 of the photosensitive screen 20 so as to apply a positive D.C. voltage having an A.C. voltage superimposed thereon to the corona wire 75. It should be noted that the secondary reverse polarity electrification step may also be performed from the side of the first photoconductive member 23c. Simultaneously with the secondary reverse polarity electrification, an optical image is projected from the side of the insulating member 22 to make the surface potentials throughout the screen 20 apparently constant. During this imagewise exposure, in a portion of the screen corresponding to a dark area of the optical image the positive charges previously trapped in the interface between the second photoconductive member 24a and the insulating member 22 are not released, so that the negative charges are held on the insulating member 22. Moreover, on the first photoconductive member 23c opposite to the insulating member 22 positive charges are stored. On the other hand, in a portion of the screen corresponding to a bright area of the optical image the previously trapped positive charges disappear and negative charges are injected and trapped, as a result of which positive charges are stored on the insulating member 22.

Figure 47:
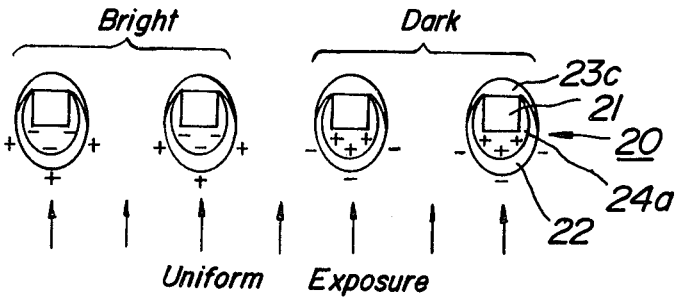

After the secondary reverse polarity charging and the optical image exposing step has been completed, the photosensitive screen 20 is subjected to a uniform exposure. In an embodiment of this exposure illustrated in FIG. 47 the photosensitive screen 20 is exposed to a uniform light from the side of the insulating member 22, but the exposure may be effected from the side of the first photoconductive member 23c or both sides. When the photosensitive screen 20 is uniformly exposed to the light, charges which correspond in amount and opposite in polarity to the charges stored on the dark and bright areas of the insulating layer 22, respectively are trapped in the interface between the second photosensitive layer 24a and the insulating layer 22 and thus the screen 20 is electrostatically balanced. Thus a primary electrostatic latent image consisting of positive and negative charges is formed on the insulating layer 22.

When the electrical potentials of the bright and dark portions of the electrostatic latent image are denoted by $V_L$ and $V_D$, respectively, the following relation exists between $V_L$ and $V_D$:

$$V_D=\alpha_P V_L-\alpha_i|V_{1D}|$$

$$-|V_{1D}|\leqq V_L\leqq|V_{2L}|$$

Figure 48:
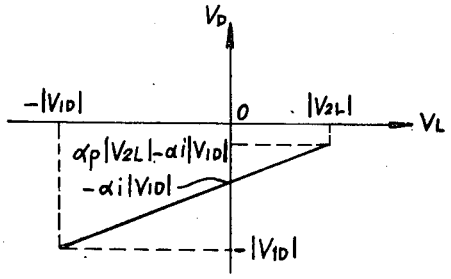
FIGS. 48 and 49 are graphs representing surface potential and electrostatic contrast, respectively, of the primary charge latent image formed on the screen.
Figure 49:
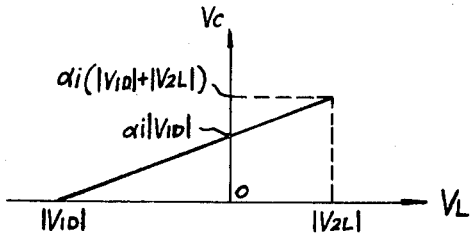

FIG. 48 and FIG. 49 illustrate this relation of $V_D$ and $V_L$ and the electrostatic constrast $V_c=|V_D-V_L|$, respectively. As apparent from FIG. 49, in theory the electrostatic contrast $V_c$ of the primary latent image can be increased to the maximum $V_c=\alpha_i(V_{2L}+|V_{1D}|)$, but in general $V_{1D}=-V_{2D}$ and hence the maximum contrast $V_{cmax}$ becomes $V_{cmax}=-2\alpha_i V_{2D}$, wherein $V_{1D}=V_{1L}$, $V_{2D}=V_{2L}=V_L$; $V_{2D}$ and $V_{2L}$ being the surface potentials of the bright and dark portions caused by the charges formed on the photosensitive screen 20 during the secondary reverse polarity electrification step.

Figure 50:
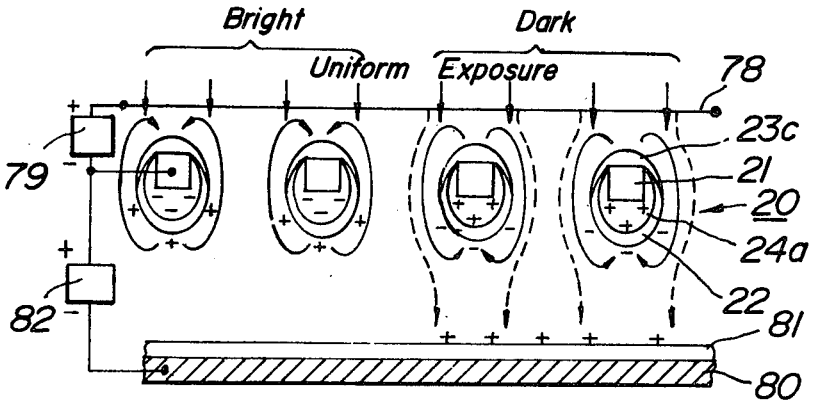
FIG. 50 is a schematic diagram illustrating a step for forming a secondary charge latent image.

FIG. 50 diagrammatically shows a step for forming a secondary electrostatic latent image on a record medium with the aid of the primary electrostatic latent image formed in the above mentioned manner. As shown in FIG. 50, a corona wire 78 is arranged opposite to the first photoconductive layer 23c of screen 20 and a D.C. corona supply source 79 is connected across the corona wire 78 and the electrically conductive layer 21 of the screen 20 so as to produce a positive corona ion stream from the corona wire 78 toward the photosensitive screen 20. Further, a record medium 81 is laid on a back electrode 80 provided opposite to the screen 20 and an acceleration supply source 82 is connected between the back electrode 80 and the electrically conductive member 21 so as to produce an electric field for accelerating the positive charges produced from the corona wire 78. In this manner the positive corona ion flow is supplied from the corona wire 78 to the record medium 81 and at the same time the screen 20 is subjected to a uniform exposure. During this process, in the apertures of the screen at the imagewise exposed portion a reverse electric field for preventing the passage of the ion flow through the apertures is present and in the apertures of the screen at the imagewise dark portion a forward field for enhancing the passage of the ion flow is present, so that a secondary electrostatic latent image without fog and with a high contrast is formed on the record medium 81. It should be noted that, if the polarities of the corona supply source 79 and the acceleration supply source 82 in FIG. 50 are reversed, a secondary latent image of negative nature can be formed.

EXAMPLE 24

In this example, use is made of the photosensitive screen 20 shown in FIG. 11 and the primary electrostatic latent image is formed in accordance with the process C. This embodiment differs from the Example 23 in that in this example since the second photosensitive member 24b of the screen 20 is of b-type, the primary charging step is performed in positive polarity. Consequently, the electrostatic contrast $V_c$ of a primary electrostatic latent image formed according to this example can be expressed as follows:

$$V_c=\alpha_i V_{2D}$$

EXAMPLE 25

In this example the photosensitive screen 20 shown in FIG. 14 is used and the primary electrostatic latent image is formed thereon in accordance with the process C. This screen comprises the first photoconductive layer 23b of b-type and the second photoconductive member 24a of a-type, so that the polarity of the primary electrification must be negative. Therefore, this embodiment is similar to the above Example 23 and the electrostatic contrast $V_c$ of a primary electrostatic latent image formed on the insulating member 22 can be given as:

$V_c = -\alpha_i V_2$

In this formula, $V_2$ is the surface potential which is caused by the charges formed on the photosensitive screen during the secondary reverse polarity electrification step.

EXAMPLE 26

In this example the photosensitive screen shown in FIG. 15 is used and the primary electrostatic latent image is formed thereon in accordance with the process C. In this embodiment, the second photosensitive member 24b of screen 20 is of b-type, so that the primary electrification should be carried out in positive polarity. Therefore, in this embodiment the primary and the secondary electrifications are in opposite polarity to those of the Example 25, respectively and thus the contrast of the primary electrostatic latent image formed on the insulating member 22 can be expressed as follows:

$V_c = \alpha_i V_2$

EXAMPLE 27

Figure 51:
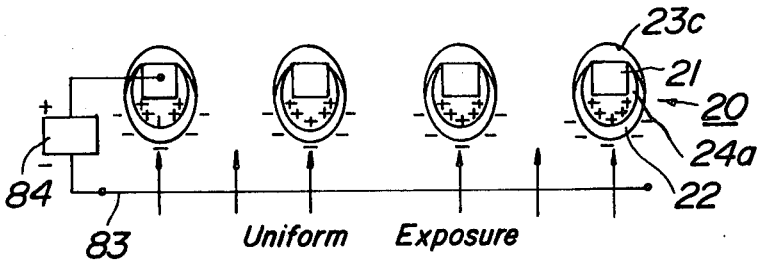
FIGS. 51, 52 and 53 are schematic views showing successive steps of a process D according to the invention while using the screen of FIG. 10

In this example the photosensitive screen 20 shown in FIG. 10 is used and the primary electrostatic latent image is formed on the insulating member 22 thereof in accordance with the process D. In this case, since the second photosensitive layer 24a of the screen 20 has the rectifying property of a-type, the primary electrification which is effected in simultaneous with the uniform exposure should be effected in negative polarity. Firstly, as shown in FIG. 51, a corona wire 83 is arranged opposite to the insulating layer 22 and a corona supply source 84 is connected between the corona wire 83 and the electrically conductive member 21 of the screen 20 so that the screen 20 is charged with negative corona ions produced from the corona wire 83 and simultaneously the screen 20 is subjected to the uniform exposure. During this process, positive charges are injected and trapped in the interface between the second photoconductive layer 24a and the insulating layer 22 of the screen, so that the photosensitive screen is uniformly electrified in a negative polarity. It is obvious that the primary electrification which is effected in simultaneous with uniform exposure may also be performed from the side of the first photoconductive member 23c of the screen 20.

Figure 52:
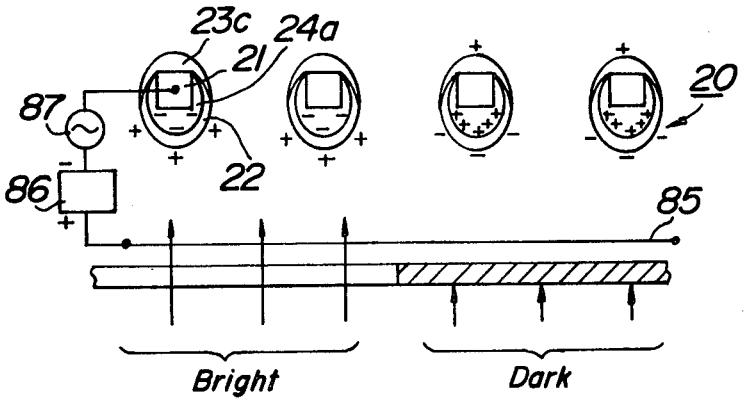

Next the secondary reverse polarity charging step is effected simultaneously with the imagewise exposure. For this purpose, as shown in FIG. 52 a corona wire 85 is arranged opposite to the insulating layer 22 and a D.C. supply source 86 and a A.C. supply source 87 are connected in series between the corona wire 85 and the electrically conductive sheet 21 of the screen 20 so that a corona discharge is produced therebetween by a D.C. voltage having an A.C. voltage superimposed thereon. Thus the screen 20 is charged from the side of the insulating layer 22 thereof in reverse polarity to that of the primary charging and at the same time the optical image is projected on the screen from the same side. As a result of this, at a portion of the screen corresponding to a bright portion of the optical image the positive charges previously trapped in the interface between the second photoconductive layer 24a and the insulating layer 22 of the screen 20 are released and negative charges are injected and trapped therein, while at a portion of the screen 20 corresponding to a dark portion of the optical image the negative charges stored on the surface of the insulating layer 22 are more or less cancelled, so that the surface potential at the bright and dark portions of the screen 20 are made apparently equal to the voltage value of the D.C. voltage source 86. It is obvious that the secondary reverse polarity charging may also be performed from the first photoconductive layer 23c.

Figure 53:
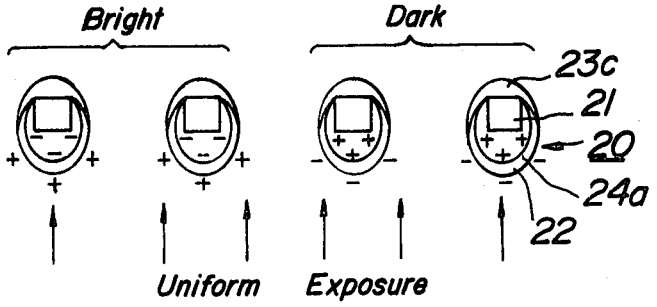

FIG. 53 shows the uniform exposure step, during which the charges trapped in the interface between the second photoconductive layer 24a and the insulating layer 22 in the dark portion of the screen 20 during the previous primary charging step are released so that the residual charges in the interface are electrostatically balanced with the charges held on the insulating layer 22 after the secondary reverse polarity charging. Therefore a primary electrostatic latent image consisting of positive and negative charges can be formed by suitably choosing the charging voltage of the secondary reverse polarity charging.

Then the relation between the electrical potentials $V_L$ and $V_D$ of the bright and dark portions of the primary latent image finally formed on the insulating layer can be expressed as follows:

$$V_D = \alpha_P V_L - \alpha_i |V_{1L}|$$

$$-|V_{1L}| \leqq V_L \leqq |V_{2L}|$$

$$|V_{1L}| = |V_{2L}|$$

Figure 54:
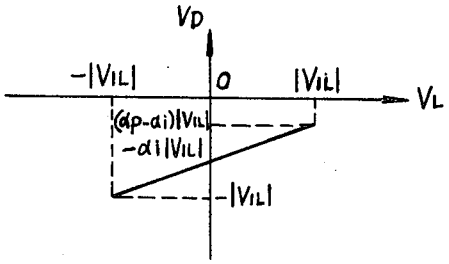
FIGS. 54 and 55 are graphs representing the surface potential and electrostatic contrast, respectively, of the primary charge image on the screen.
Figure 55:
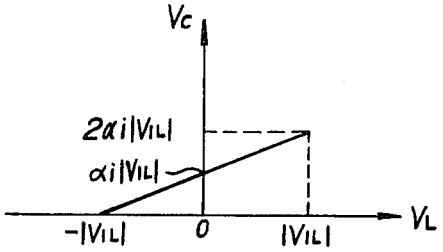

FIG. 54 and FIG. 55 show the relations between $V_L$ and $V_D$ and between $V_c$ and $V_L$, respectively. As apparent from these figures, when the charging voltage of the secondary reverse polarity charging is so selected that the potential $V_L$ of the bright portion is $0 \leqq V_L \leqq |V_{1L}|$, an electrostatic contrast $V_c$ becomes $V_c = \alpha_i(V_{2L} + |V_{1L}|)$ and for $|V_{2L}| = |V_{1L}|$ the maximum contrast $V_{cmax}$ becomes $V_{cmax} = 2\alpha i |V_{1L}|$.

Figure 56:
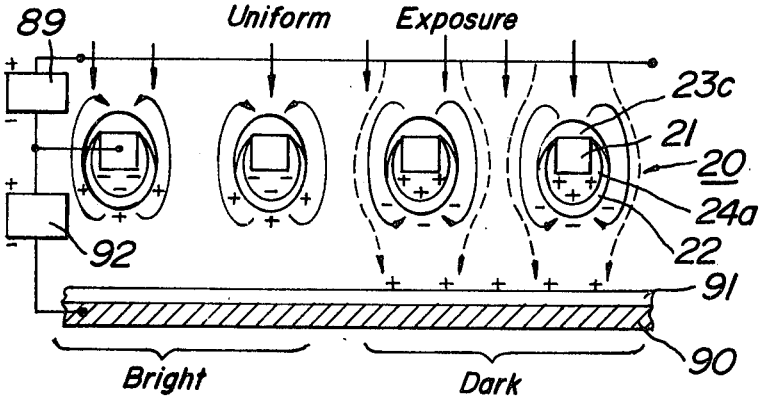
FIG. 56 is a schematic view showing a secondary charge image forming step.

FIG. 56 shows a step in which the secondary electrostatic latent image is formed on a record medium by modulating a corona ion flow toward the record medium in accordance with the primary electrostatic latent image obtained in the above mentioned manner. In this case, a corona supply source 89 is connected between a corona wire 88 arranged opposite to the first photoconductive layer 23c and the electrically conductive member 21 of the screen 20 so as to produce a positive corona ion stream toward the screen 20 and simultaneously the screen 20 is subjected to a uniform exposure. Further on the side of the insulating layer 22 of the screen a back electrode 90 is arranged opposite to the screen 20, on which electrode a record medium 91 is placed and an acceleration voltage source 92 is connected between the back electrode 90 and the electrically conductive sheet 21 of the screen so that the positive corona ion flow passed through the apertures of the screen is accelerated to the record medium 91. During this step, the apertures at the dark portion of the screen 20 have a reverse field preventing the passage of the ion flow and the apertures of the bright portion of the screen have a forward field enhancing the passage of the ion flow, so that the record medium 91 receives the positive charges only at portions of the record medium which correspond to the dark portions of the screen and thus a secondary electrostatic latent image without fog and with a high contrast is obtained on the record medium. It is obvious that if the corona voltage source 89 and the acceleration voltage source 92 are reversed in polarity, the secondary latent image consisting of negative charges can be obtained. Further, it should be noted that if the record member is uniformly precharged in one polarity to a predetermined potential, the secondary latent image consisting of positive and negative charges can be obtained.

EXAMPLE 28

In this example the primary electrostatic latent image is formed on the photosensitive screen 20 shown in FIG. 11 in accordance with the process D. This example differs from the Example 27 in a point that the primary charging process which is effected simultaneously with the uniform exposure as shown in FIG. 51 is performed in positive polarity, because the second photoconductive layer **24*b* of the screen 20** is of b-type. Thus, the contrast $V_c$ of the primary electrostatic latent image according to this Example can be given as:

$$V_c=\alpha_i V_{2D}$$

EXAMPLE 29

In this example the photosensitive screen 20 shown in FIG. 12 is used and the primary electrostatic latent image is formed thereon by means of the process D. Since this photosensitive screen comprises the second photoconductive layer **24*c* on which both positive and negative charges can be given, the primary charging which is effected simultaneously with the uniform exposure as shown in FIG. 51 can be effected in either positive or negative polarity. In this Example the primary charging step is performed in positive polarity. Thus the contrast $V_c$ of the primary electrostatic latent image formed on the insulating layer 22** according to this example can be given as:

$$V_c=\alpha_i V_2$$

EXAMPLE 30

In this example the primary charging step which is effected simultaneously with the uniform exposure in the above example 29 is of the negative polarity. Therefore, the contrast $V_c$ of the primary latent image finally formed on the insulating layer according to this example can be expressed as follows:

$$V_c=-\alpha_i V_{2D}$$

EXAMPLE 31

In this example use is made of the photosensitive screen 20 illustrated in FIG. 13, on which the primary latent image is formed by means of the process D. The difference of this example from the Example 29 is that the photosensitive screen 20 comprises the first photoconductive layer **23*b* of b-type. Therefore, the contrast $V_c$ of the primary latent image obtained on the insulating layer 22** according to this example can be expressed as follows:

$$V_c=\alpha_i V_{2D}$$

EXAMPLE 32

In this example the primary charging which is effected simultaneously with the uniform exposure in the above Example 31 is of the negative polarity. Accordingly, this example provides a primary latent image having a contrast $V_c$ which can be expressed as follows:

$$V_c=-\alpha_i V_2$$

EXAMPLE 33

In this example the photosensitive screen 20 as shown in FIG. 14 is used on which the primary latent image is formed by means of the process D. Since the second photoconductive layer **24*a* of this screen has the rectifying property of a-type, the charging polarity of the primary charging which is effected in simultaneous with the uniform exposure must be negative. Therefore, the primary latent image formed on the insulating layer 22** according to this example has a contrast $V_c$ which can be expressed as follows:

$$V_c=-\alpha_i V_2$$

This means that the contrast $V_c$ is determined by the surface potential caused by the charges applied on the photosensitive screen 20 during the secondary charging which is effected simultaneously with the optical image projection.

EXAMPLE 34

In this example the photosensitive screen 20 shown in FIG. 15 is used and the primary latent image is formed thereon by means of the process D. In this example since this screen has the second photoconductive layer **24*b* of b-type, the primary charging which is effected in simultaneous with uniform exposure must be of the positive polarity. Therefore, in this example primary and secondary charging steps are opposite in polarity to those of the Example 33 and thus the electrostatic contrast $V_c$ of the electrostatic charge latent image formed on the insulating layer 22** can be given as:

$$V_c=\alpha_i V_2$$

EXAMPLE 35

Figure 57:
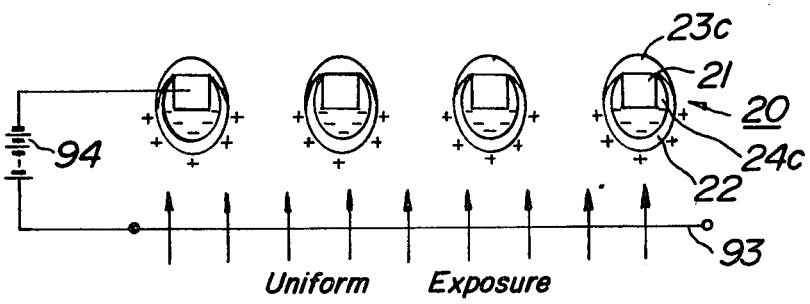
FIGS. 57, 58, 59 and 60 are schematic views showing successive steps of the process D according to the invention while using the screen of FIG. 16

In the present example, use is made of the photosensitive screen 20 shown in FIG. 16 so as to produce, on the insulating layer 22, a primary electrostatic latent image according to the process D. As shown in FIG. 57, a corona discharge wire 93 of the corona discharge device is arranged at the side of the insulating layer 22 of the photosensitive screen 20. Between the corona discharge wire 93 and the electrically conductive core 21 is connected a corona supply source 94. In the first time, the photosensitive screen 20 is uniformly exposed to light and at the same time is uniformly charged with a positive polarity. As a result, a negative charge is trapped on a boundary surface between the second photoconductive layer **24*c* and the insulating layer 22. The above mentioned simultaneous exposing and primary charging step may be effected from the side of the first photoconductive layer 23*c***.

Then, the photosensitive screen 20 is subjected to the simultaneous optical image projection and second opposite polarity charging step. For this purpose, a corona discharge wire 95 is arranged at the side of the insulating layer 22 of the photosensitive screen 20. In order to permit the corona discharge wire 95 to effect the alternating current corona discharge with the negative direct current voltage superimposed thereon, the direct current supply source 96 and an alternating current supply source 97 are connected in series between the electrically conductive sheet 21 and the corona discharge wire 95. In this way, it is possible to effect the secondary charging step with the opposite polarity and at the same time to project the optical image toward the insulating layer 22. As a result, in the imagewise exposed area of the photosensitive screen 20, the negative charges which have been trapped are released and the positive charges corresponding to the negative charges to be charged on the insulating layer 22 are injected into the boundary surface and trapped therein. In the imagewise dark area of the photosensitive screen 20, the charges trapped in the boundary surface are not released, so that the positive charges on the insulating layer 22 are cancelled by the negative charge produced due to the secondary opposite polarity charging step. As a result, the surface potential in the imagewise exposed area of the photosensitive screen 20 becomes apparently equal to the surface potential in the imagewise dark area of the photosensitive screen 20. The secondary opposite polarity charging step may be effected toward the first photoconductive layer 23*c*.

Figure 58:
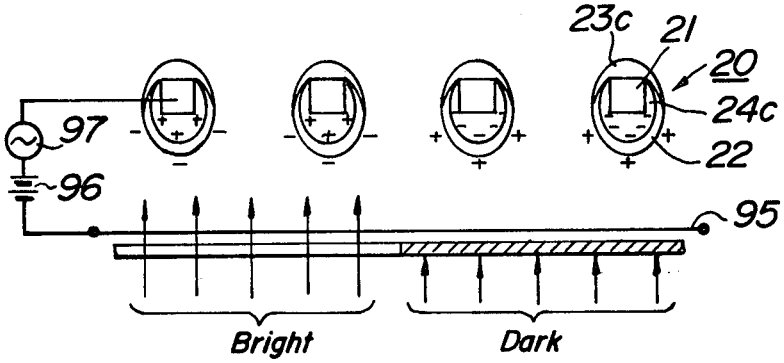
Figure 59:
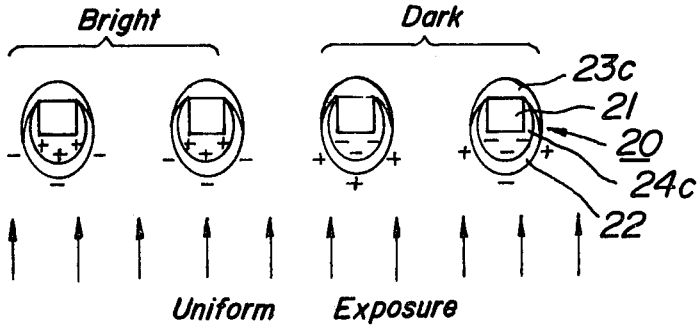

FIG. 59 shows the uniform exposing step to be carried out after the simultaneous optical image projection and second opposite polarity charging step has been effected. In the imagewise dark area of the photosensitive screen 20, this uniform exposing step permits the electric charges trapped in the boundary surface between the second photoconductive layer 24*c* and the insulating layer 22 during the simultaneous uniform exposing and first charging step shown in FIG. 57 to release. As a result, the electric charges in the boundary surface electrostatically are balanced with the electric charges held on the insulating layer 22 after the simultaneous optical image projection and second opposite polarity charging step shown in FIG. 58. As a result, it is possible to produce, on the insulating layer 22, the primary electrostatic latent image composed of positive and negative charges by properly selecting the charging voltage in the second opposite polarity charging step.

The electrostatic contrast $V_c$ of the primary electrostatic latent image produced on the insulating layer 22 is given by:

$$V_c=\alpha_i V_{2D}$$

The surface potential $V_L$ of the primary electrostatic latent image in the imagewise exposed area and the surface potential $V_D$ of the primary electrostatic latent image in the imagewise dark area have the relations given by:

$$V_D=\alpha_p V_L-\alpha_i V_{1L}$$

$$-V_{1L}\leqq V_L\leqq V_{1L}.$$

If $V_L=V_{1L}$, then the maximum electrostatic contrast $V_{cmax}$ is given by:

$$V_{cmax}=2\alpha_i V_{1L}.$$

In FIG. 59, the uniform exposing step is effected toward the insulating layer 22. Alternatively, the uniform exposing step may be effected toward the first photoconductive layer 23*c* or toward both the insulating layer 22 and the first photoconductive layer 23*c*.

Figure 60:
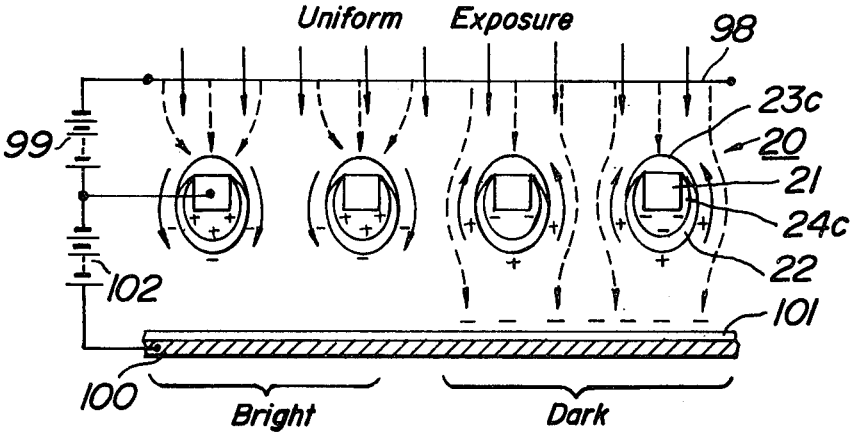

FIG. 60 is a diagrammatic view showing one example of the step of modulating the flow of corona ions by the primary electrostatic latent image produced on the insulating layer 22 in the manner described above so as to produce, on the record medium, the second electrostatic latent image. In the present example, between the corona discharge wire 98 arranged at the side of the first photoconductive layer 23*c* of the photosensitive screen 20 and the electrically conductive core 21 is connected a direct current corona supply source 99. The photosensitive screen 20 is uniformly exposed to light and at the same time the flow of negative corona ions is directed toward the photosensitive screen 20. To the side of the insulating layer 22 of the photosensitive screen 20 is opposed a record medium 101 placed on a field electrode 100 and between the field electrode 100 and the electrically conductive core 21 of the photosensitive screen 20 is connected an acceleration electric supply source 102. The acceleration electric supply source 102 functions to guide the flow of negative corona ions passed through the openings of the photosensitive screen 20 toward the record medium 101. The electric field for accelerating the passage of the flow of negative corona ions is produced at the openings in the imagewise dark area of the photosensitive screen 20 and the electric field for blocking the passage of the flow of negative corona ions is produced at the openings in the imagewise exposed area of the photosensitive screen 20. As a result, only to that part of the record medium 101 which corresponds to the imagewise dark area of the photosensitive screen does the negative electric charge adhere, thereby producing, on the record medium 101, the secondary electrostatic latent image not overdeveloped and having a high contrast.

If the polarity of the corona supply source 99 and the acceleration electric supply source 102 is made opposite, the flow of corona ions passes through the imagewise exposed area, so that it is possible to produce, on the record medium, the secondary electrostatic latent image of the negative due to the negative electric charge.

In addition, if the record medium 101 is uniformly charged beforehand with the given potential having one polarity, it is possible to produce, on the record medium, a secondary electrostatic latent image composed of both positive and negative charges.

EXAMPLE 36

In the present example, use is made of the photosensitive screen 20 shown in FIG. 16 so as to produce thereon the primary electrostatic latent image according to the process D, but the simultaneous uniform exposing and primary charging step shown in FIG. 57 is effected with the negative polarity. As a result, the present example is similar to the above mentioned Example 27. The electrostatic contrast $V_c$ of the primary electrostatic latent image produced on the insulating layer 22 is given by $$V_c=-\alpha_i V_{2D}.$$

The surface potential $V_L$ of the primary electrostatic latent image in the imagewise exposed area and the surface potential $V_D$ of the primary electrostatic latent image in the imagewise dark area have the relations given by $$V_D=\alpha_p V_L-\alpha_i|V_{1L}|$$

$$-|V_{1L}|\leqq V_L\leqq|V_{1L}|.$$

If $V_L=|V_{1L}|$, the maximum electrostatic contrast $V_{cmax}$ is given by $$V_{cmax}=2\alpha_i|V_{1L}|.$$

EXAMPLE 37

In the present example, use is made of the photosensitive screen 20 shown in FIG. 17 so as to produce thereon the primary electrostatic latent image according to the process D. Both the first and second photoconductive layers 23*a*, 24*a* of the photosensitive screen 20 shown in FIG. 17 are of a-type, respectively, so that the simultaneous exposing and primary charging step shown in FIG. 57 must be effected in the negative polarity. As a result, the present example is similar to the above mentioned Example 36. The electrostatic contrast $V_c$ of the primary electrostatic latent imge produced on the insulating layer 22 is given by $$V_c = -\alpha_i V_{2D}.$$

In the present example, if the polarity of the flow of corona ions for producing, on the record medium, the secondary electrostatic latent image is negative, the uniform exposing step may be omitted in the case of producing, on the record medium, the secondary electrostatic latent image.

EXAMPLE 38

In the present example, use is made of the photosensitive screen 20 shown in FIG. 18 so as to produce thereon the primary electrostatic latent image according to the process D. Since both the first and second photoconductive layers 23*b*, 24*b* of the photosensitive screen 20 have b-type rectification characteristic, respectively. The simultaneous uniform exposing and primary charging step must be effected with the positive polarity. As a result, the present example is similar to the above mentioned Example 35. The electrostatic contrast $V_c$ of the primary electrostatic latent image produced on the insulating layer 22 is given by $$V_c = \alpha_i V_{2D}.$$

In the present example, if the polarity of the corona ion stream for producing, on the record medium, the secondary electrostatic latent image is positive, the uniform exposing step may be omitted in the case of producing, on the record medium, the secondary electrostatic latent image.

EXAMPLE 39

In the present example, use is made of the photosensitive screen 20 shown in FIG. 10 so as to produce, on the insulating layer 22, the primary electrostatic latent image according to the process E.

Figure 61:
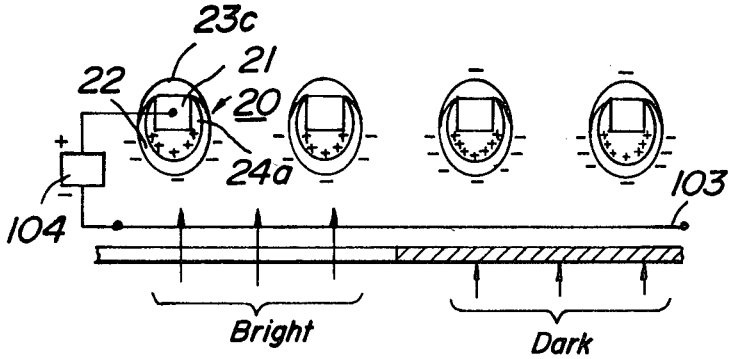
FIGS. 61, 62, 63, 64 and 65 are schematic diagrams showing successive steps of a process E according to the invention while using the screen illustrated in FIG. 10

As shown in FIG. 61, a corona discharge wire 103 is arranged at the side of the insulating layer 22 of the photosensitive screen 20. Between the corona discharge wire 103 and the electrically conductive sheet 21 is connected a corona supply source 104. The photosensitive screen 20 is uniformly charged with a negative polarity and at the same time the optical image is projected toward the insulating layer 22. In this case, the first photoconductive layer 23*c* is equivalent to an electrically conductive body in the imagewise exposed area of the photosensitive screen 20, but is of a high resistant body in the imagewise dark area thereof. As a result, if the photosensitive screen 20 is sufficiently charged, the absolute value of the surface potential $V_{1D}$ in the imagewise dark area of the photosensitive screen 20 becomes larger than that of the surface potential $V_{1L}$ in the imagewise exposed area thereof. In FIG. 61, the primary charging step may be effected toward the photoconductive layer 23*c*.

Figure 62:
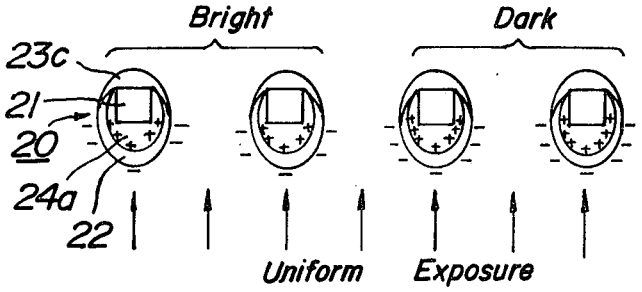

Then, as shown in FIG. 62, the photosensitive screen 20 is uniformly exposed to light. In the imagewise dark area of the photosensitive screen 20, this uniform exposing step permits the electric charges on the first photoconductive layer 23*c* to disappear, thereby producing a potential difference $V_{1D}-V_{1L}$ between the imagewise dark area and the imagewise exposed area of the photosensitive screen 20. The uniform exposing step may be effected toward the insulating layer 22 and/or toward the first photoconductive layer 23*c*.

Figure 63:
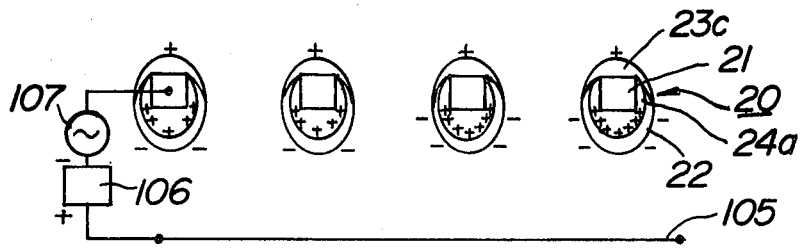

Subsequently, the photosensitive screen 20 is charged with a polarity which is opposite to the polarity used in the simultaneous optical image projection and primary charging step. For this purpose, in the present example, as shown in FIG. 63, a corona discharge wire 105 is arranged at the side of the insulating layer 22 of the photosensitive screen 20. Between the corona discharge wire 105 and the electrically conductive core 21 are connected a direct current supply source 106 and an alternating current supply source 107 in series, thereby effecting an alternating current corona discharge with a positive direct current voltage superimposed thereon. As a result, both the imagewise exposed and dark areas of the photosensitive screen 20 are apparently uniformly charged with the direct current voltage. This secondary opposite polarity charging step may be effected toward the first photoconductive layer 23*c*.

Figure 64:
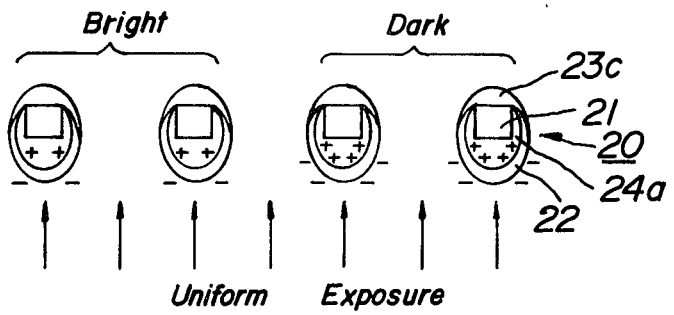

FIG. 64 shows the uniform exposing step to be carried out after the above mentioned secondary opposite polarity charging step has been effected. In this step, the electric charges held on the insulating layer 22 after the secondary opposite polarity charging and the corresponding electric charges having the opposite polarity are trapped on the boundary surface between the second photoconductive layer 24*a* and the insulating layer 22 and hence become electrostatically balanced with each other. As a result, it is possible to produce, on the insulating layer 22 of the photosensitive screen 20, a primary electrostatic latent image whose electrostatic contrast $V_c$ is given by $$V_c = -\alpha_i(V_{1D}-V_{1L}).$$

In FIG. 64, the negative charge is held on the insulating layer 22 in both the imagewise exposed area and the imagewise dark area of the photosensitive screen 20. But, the positive or negative charge may be held on the insulating layer 22 in the imagewise exposed area and the imagewise dark area of the photosensitive screen 20 by properly selecting the charging voltage in the secondary reverse plarity charging step shown in FIG. 63. In addition, the uniform exposing step may be effected toward the insulating layer 22 and/or the first photoconductive layer 23*c*.

Figure 65:
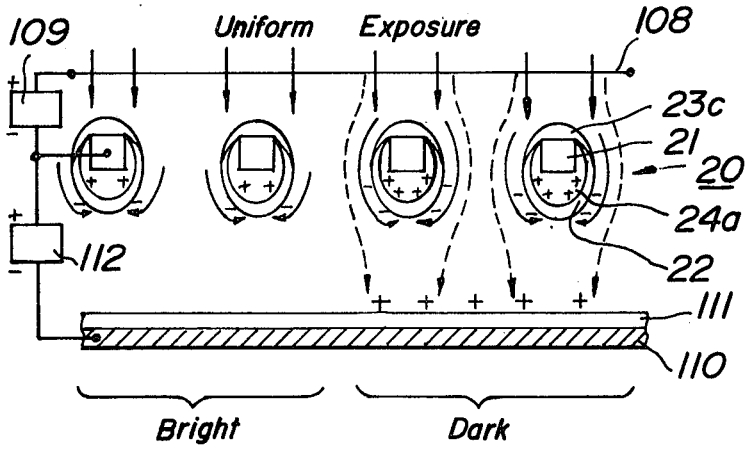

FIG. 65 is a diagrammatic view showing one example of a step of modulating the flow of corona ions by the primary electrostatic latent image produced on the insulating layer 22 in the manner described above so as to produce, on the record medium, the secondary electrostatic latent image. In the present example, between a corona discharge wire 108 arranged at the side of the first photoconductive layer 23*c* of the photosensitive screen 20 and the electrically conductive core 21 is connected a direct current corona supply source 109. The photosensitive screen 20 is uniformly exposed and at the same time a flow of positive corona ions is directed toward the photosensitive screen 20. Adjacent the side of the insulating layer 22 of the photosensitive screen 20 is a record medium 111 placed on a field electrode 110 and between the field electrode 110 and the electrically conductive core 21 of the photosensitive screen 20 is connected an acceleration electric supply source 112.

The acceleration electric supply source 112 functions to guide the flow of positive corona ions passed through the apertures of the photosensitive screen 20 toward the record medium 111. An electric field for accelerating the passage of the flow of positive corona ions is produced in the apertures in both the imagewise exposed area and the imagewise dark area of the photosensitive screen 20, the electric field intensity in the imagewise exposed area being different from that in the imagewise dark area. As a result, the second electrostatic latent image produced on the record medium 111 becomes overdeveloped. In order to avoid such a drawback, the record medium 111 must uniformly be charged beforehand to a negative potential having a negative polarity.

EXAMPLE 40

In the present example, use is made of the photosensitive screen 20 shown in FIG. 11 so as to produce, on the insulating layer 22, the primary electrostatic latent image according to the process E. In the present example, in the simultaneous optical image projection and primary charging step shown in FIG. 61, the photosensitive screen 20 is uniformly charged with a positive polarity contrary to the Example 39. As a result, it is possible to produce, on the insulating layer 22 of the photosensitive screen 20, the primary electrostatic latent image whose electrostatic contrast $V_c$ is given by $$V_c=\alpha_f(V_{1D}-V_{1L}).$$

EXAMPLE 41

In the present example, use is made of the photosensitive screen 20 shown in FIG. 12 so as to produce, on the insulating layer 22, the primary electrostatic latent image according to the process E. In the present example, in the simultaneous optical image projection and primary charging step shown in FIG. 61, the photosensitive screen 20 is uniformly charged with a positive polarity similar to the above described Example 40. As a result, it is possible to produce, on the insulating layer 22 of the photosensitive screen 20, the primary electrostatic latent image whose electrostatic contrast $V_c$ is given by $$V_c=\alpha_f(\alpha_p V_{1D}-V_{1L}).$$

EXAMPLE 42

In the present example, use is made of the photosensitive screen 20 shown in FIG. 12 so as to produce, on the insulating layer 22, the primary electrostatic latent image according to the process E. In the present example, in the simultaneous imagewise exposure and primary charging step shown in FIG. 61, the photosensitive screen 20 is uniformly charged with a negative polarity contrary to the Example 41. As a result, it is possible to produce, on the insulating layer 22 of the photosensitive screen 20, the primary electrostatic latent image whose electrostatic contrast $V_c$ is given by $$V_c=\alpha_f^2 V_1$$

where $V_1$ is a surface potential produced by the electric charge supplied to the photosensitive screen due to its primary charging step.

EXAMPLE 43

In the present example, use is made of the photosensitive screen 20 shown in FIG. 13 so as to produce, on the insulating layer 22, the primary electrostatic latent image according to the process E. In the present example, in the simultaneous optical image projection and primary charging step shown in FIG. 61, the photosensitive screen 20 is uniformly charged with a positive polarity in the same manner as the Example 41. As a result, it is possible to produce, on the insulating layer 22 of the photosensitive screen 20, the primary electrostatic latent image whose electrostatic contrast $V_c$ is given by $$V_c=-\alpha_f^2 V_1.$$

EXAMPLE 44

In the present example, use is made of the photosensitive screen 20 shown in FIG. 13 so as to produce, on the insulating layer 22, the primary electrostatic latent image according to the process E. In the present example, the simultaneous imagewise exposure and primary charging step shown in FIG. 61 is effected such that the photosensitive screen 20 is uniformly charged with a negative polarity contrary to the Example 43. As a result, it is possible to produce, on the insulating layer 22 of the photosensitive screen 20, the primary electrostatic latent image whose electrostatic contrast $V_c$ is given by $$V_c=-\alpha_f(\alpha_p V_{1D}-V_{1L}).$$

EXAMPLE 45

In the present example, use is made of the photosensitive screen 20 shown in FIG. 14 so as to produce, on the insulating layer 22, the primary electrostatic latent image according to the process E. In the present example, the simultaneous optical image projection and primary charging step shown in FIG. 61 is effected such that the photosensitive screen 20 is uniformly charged with a positive polarity. As a result, it is possible to produce, on the insulating layer 22 of the photosensitive screen 20, the primary electrostatic latent image whose electrostatic contrast $V_c$ is given in the similar manner as the Example 39 by $$V_c=-\alpha_f(V_{1D}-V_{1L}).$$

EXAMPLE 46

In the present example, use is made of the photosensitive screen 20 shown in FIG. 15 so as to produce, on the insulating layer 22, the primary electrostatic latent image according to the process E. In the present example, the simultaneous imagewise exposure and primary charging step shown in FIG. 61 is effected such that the photosensitive screen 20 is uniformly charged with a negative polarity. As a result, it is possible to produce, on the insulating layer 22 of the photosensitive screen 20, the primary electrostatic latent image whose electrostatic contrast $V_c$ is given in the similar manner as the Example 40 by $$V_c=\alpha_f(V_{1D}-V_{1L}).$$

EXAMPLE 47

Figure 66:
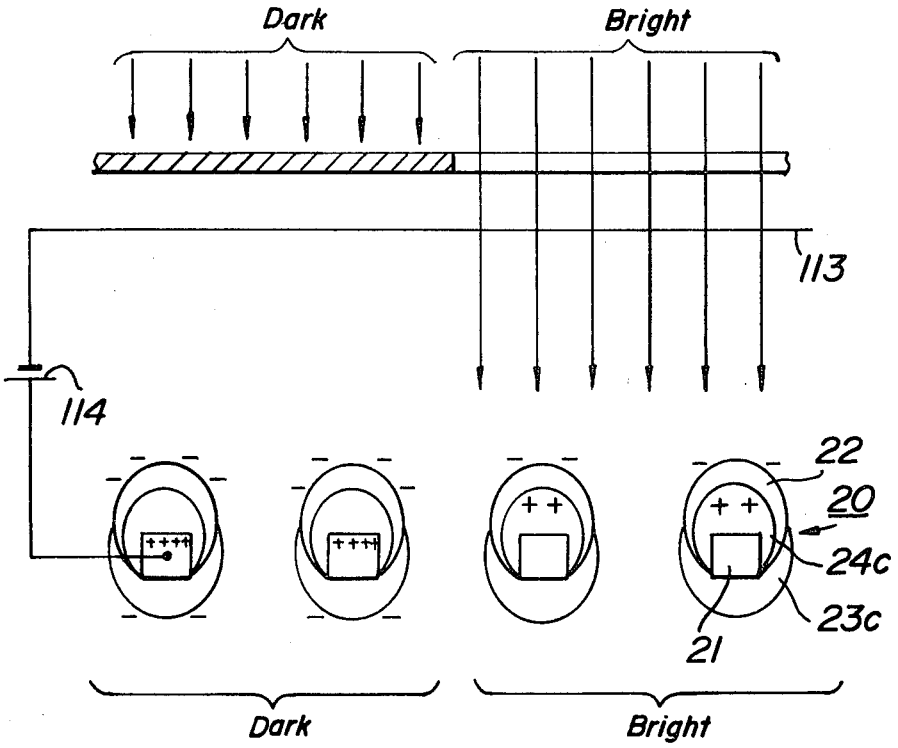
FIGS. 66, 67, 68, 69 and 70 are schematic views depicting successive steps of the process E according to the invention while using the screen of FIG. 16.

In this example use is made of the photosensitive screen 20 shown in FIG. 16 and the primary latent image is formed in accordance with the process E. FIG. 66 illustrates the imagewise exposure and primary charging step to be effected from the side of the insulating layer 22. This primary charging is performed with negative corona ions. To this end a D.C. corona supply source 114 of, for example, 8 kv is connected across a corona wire 113 and the conductive sheet 21 of screen 20 so as to generate the negative corona ions from the wire 113. The screen 20 is charged to a surface potential of several hundred volts in the imagewise dark area and to a lower potential in the imagewise exposed area. In the present example since the screen 20 does not include the opaque conductive layer 54 as in Example 21, the resistance of first photoconductive layer 23c becomes lower in the bright area and thus its surface potential becomes lower than that in the dark area.

Figure 67:
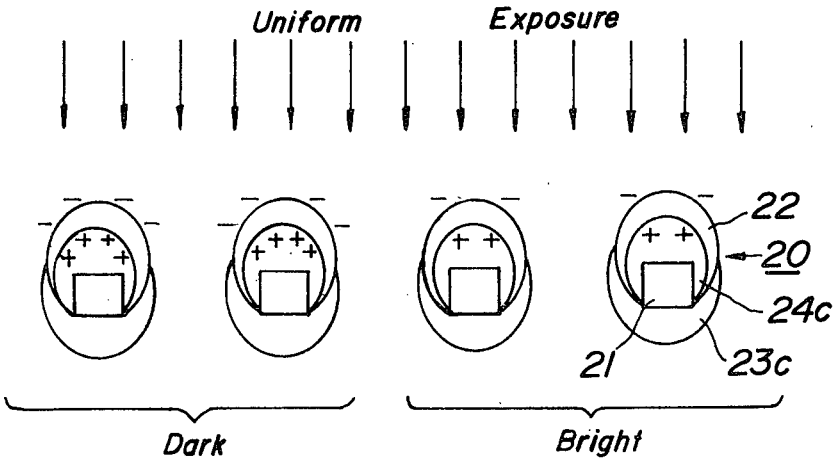

Next, as illustrated in FIG. 67, the screen 20 is subjected to a uniform exposure from the side of the insulating layer 22. During this uniform exposure step the charges at the dark area move into the interface between the insulating layer 22 and second photoconductive layer 24c and thus the surface potentials at both the dark and bright areas become lower. But the charges which have been trapped at the imagewise exposed area remain unchanged.

Figure 68:
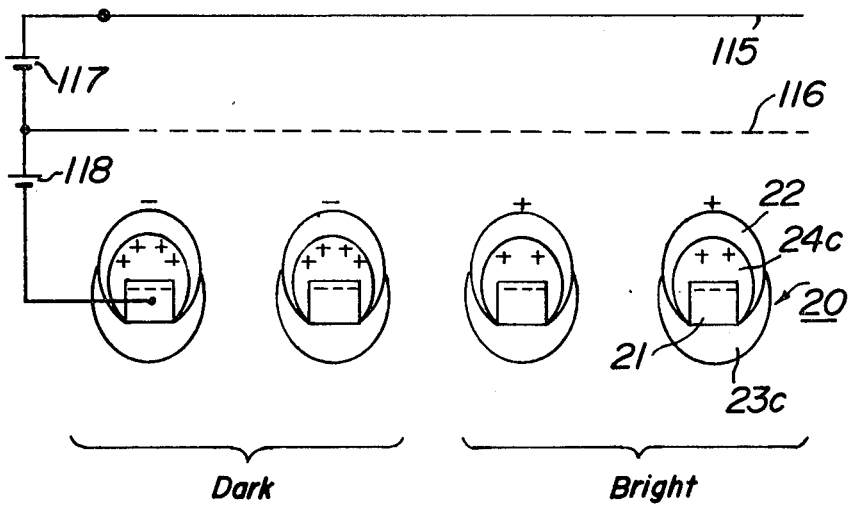

FIG. 68 shows the secondary charging step which is to be done in the opposite polarity to that of the primary charging shown in FIG. 66, That is to say in the dark the positive polarity electrification is performed toward the insulating layer 22. In this case between a corona wire 115 and the screen 20 is arranged a grid 116 to which the negative terminal of a D.C. corona supply source 117 is connected, the positive terminal of which is coupled to the wire 115. Moreover between the grid 116 and the conductive sheet 21 of screen 20 is connected a bias supply source 118 having a suitable voltage value. Therefore the screen can be charged to a voltage equal to said bias voltage. It should be noted that the charge applied to the first photoconductive layer 23c is cancelled out.

Figure 69:
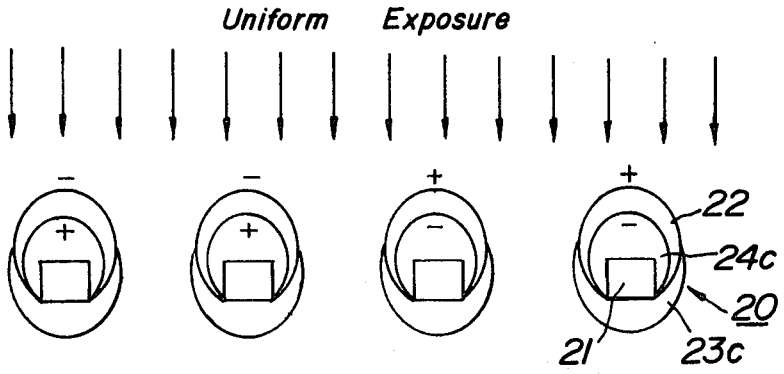

Next the screen 20 is subjected to a uniform exposure as shown in FIG. 69. This results in that the potential in the dark area becomes negative and that in the brightly exposed area becomes positive so as to form the primary latent image composed of positive and negative charges and having a high electrostatic contrast.

Figure 70:
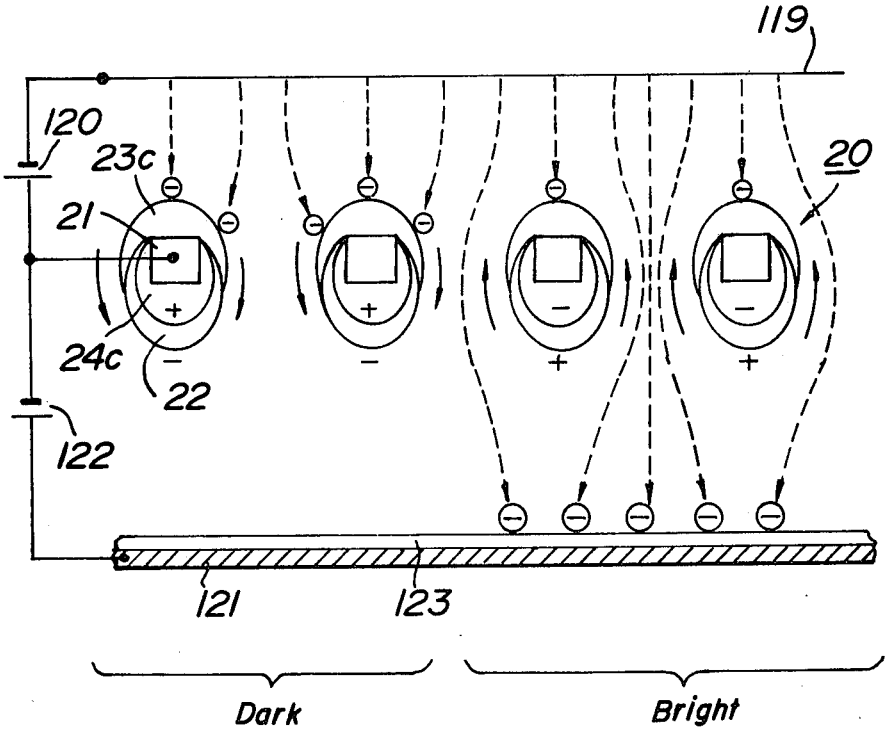

FIG. 70 depicts a manner of forming the secondary charge latent image on a record medium by modulating a corona ion stream with the primary charge image. For this purpose negative corona ions are projected from a corona wire 119 toward the insulating layer 22 of screen 20. Across the wire 119 and the conductive sheet like member 21 is connected a D.C. corona supply source 120 of, for example, 8 kv and across the conductive member 21 and a field electrode 121 is connected an accelerating supply source 122 of, for instance 4 kv. A record medium 123 is placed on the electrode 121. In the imagewise bright area there is formed a forward electric field for accelerating the passage of the negative corona ion stream through the screen and thus the corona ions pass through the apertures of screen and reach the record medium under the influence of the acceleration field produced by the supply source 122. On the other hand, in the imagewise dark area there is generated a blocking electric field for preventing the passage of the corona ion stream through the screen 20 and thus the corona ions do not pass through the screen 20. In this manner there is formed on the record medium 123 the secondary latent image composed of negative charges and having a negative image with respect to the optical image of the document to be copied.

Figure 71:
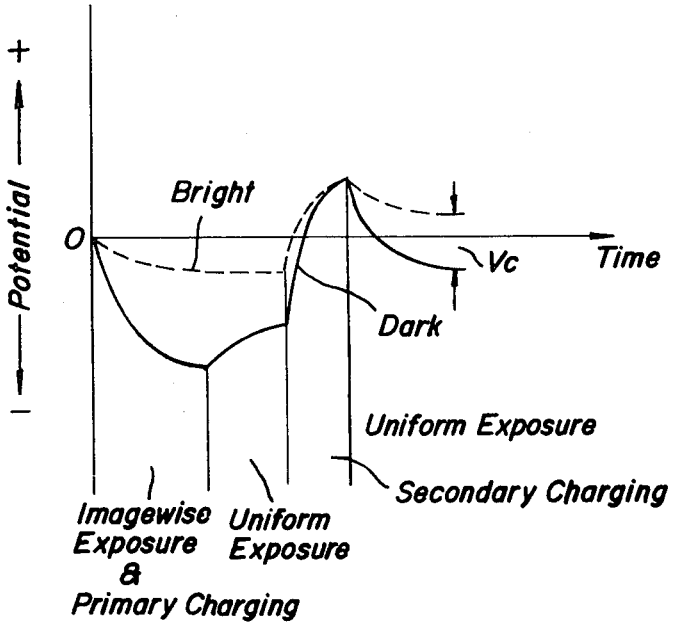
FIGS. 71 is a graph showing a change in surface potential of the photosensitive screen under the successive steps shown in FIGS. 66 to 70.

FIG. 71 is a graph showing a charge of the surface potential of screen 20 at succesive steps. A solid line denotes the surface potential in the imagewise dark area and a broken line in the imagewise exposed area. The electrostatic contrast $V_c$ of the finally formed primary charge image is given as follows:

$$V_c = -\alpha_i(\alpha_p V_{1D} - V_{1L}).$$

It is apparent that also in this example the primary latent image of a positive nature may be formed by suitably effecting the secondary charging step.

EXAMPLE 48

This example differs from the previous Example 47 only in that the primary charging which is to be performed simultaneously with the imagewise exposure is carried out in a positive polarity. Therefore the secondary charging is effected with negative corona ions. The secondary charging is continued until the surface potential of the screen shown in FIG. 16 becomes a suitable negative voltage and then the primary latent image of a negative nature can be obtained in which the potential in the imagewise dark and exposed areas are in positive and negative respectively. The electrostatic contrast $V_c$ of the primary latent image is represented by the following equation:

$$V_c = \alpha_i(\alpha_p V_{1D} - V_{1L}).$$

EXAMPLE 49

In this example use is made of the photosensitive screen shown in FIG. 39 in which the opaque conductive layer 54 is applied under the first photoconductive layer 23c and the primary charge latent image is formed on the screen in according with the process E. As explained in the Example 21 during the primary charging step the imagewise dark and exposed areas of the screen are charged to substantially the same potential due to the existence of the opaque layer 54. Next, when the uniform exposure step is carried out, the charges in the imagewise dark area move to the boundary between the second photoconductive layer 24c and the insulating layer 22 and thus the potential in this dark area becomes lower. As a result thereof the contrast between the imagewise dark and exposed areas becomes larger. In order to decrease the surface potential in the dark area during the uniform exposure to a great extent, the thickness of the insulating layer 22 is preferably made thinner than that of the second photoconductive layer 24c.

Figure 72:
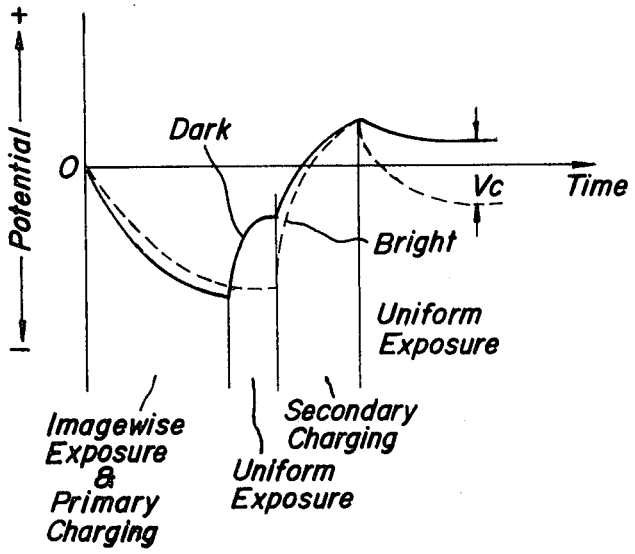
FIGS. 72 is a graph showing a change in surface potential of the screen illustrated in FIG. 39 under the successive steps of the process E according to the invention.

Next the secondary electrification is performed in a polarity opposite to the primary charging and finally the whole screen is subjected to the uniform exposure to form the primary charge latent image. The change of the surface potential of the screen in successive steps is shown in FIG. 72. In this example the primary and secondary charging steps are effected in negative and positive polarities, respectively.

EXAMPLE 50

Figure 73:
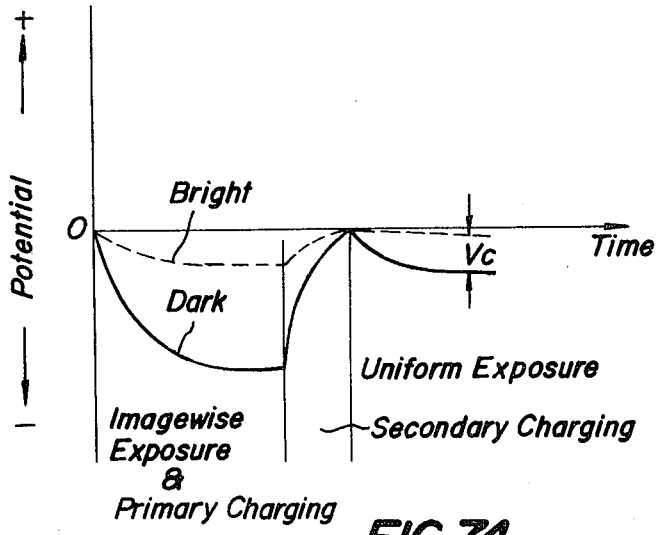
FIG. 73 is a graph representing a change in surface potential of the screen shown in FIG. 16 under the successive steps of the process B according to the invention.

In this example use is made of the photosensitive screen 20 shown in FIG. 16 and the primary electrostatic charge image is formed on this screen in accordance with the process B. FIG. 73 is a graph showing the surface potential of the screen at various steps of the process B.

EXAMPLE 51

Figure 74:
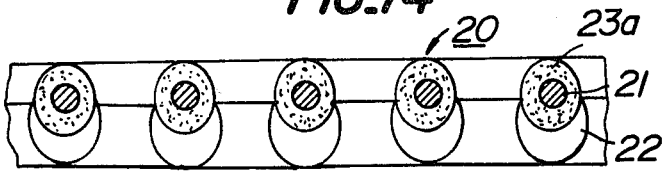
FIG. 74 is a cross section showing still another embodiment of the photosensitive screen according to the present invention.

In this example use is made of a photosensitive screen 20 illustrated in FIG. 74 and the primary charge latent image is formed on the screen in accordance with the process A. In principle this screen 20 is the same as that shown in FIG. 17, but in this embodiment the first and second photoconductive layers 23*a* and 24*a* shown in FIG. 17 are constituted by a single photoconductive layer of a-type material which is denoted by reference numeral 23*a* in FIG. 74. Such a photoconductive layer 23*a* may be formed by evaporation, sputtering, spraying.

Figure 75:
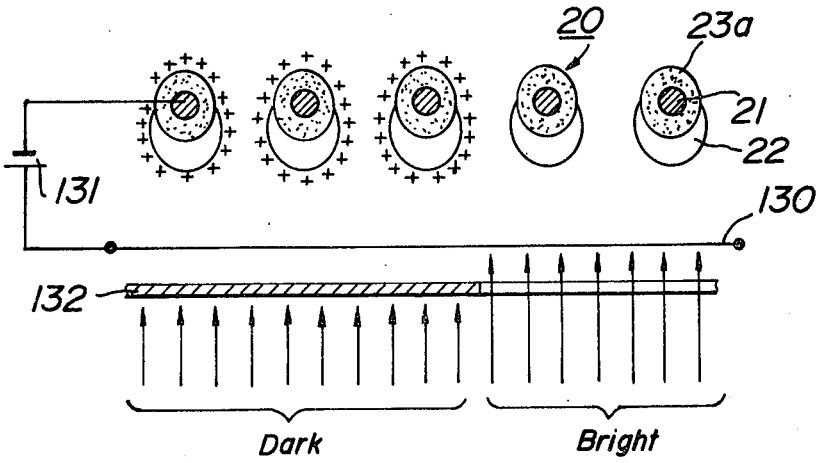
FIGS. 75, 76, 77 and 78 are schematic views representing the successive steps of the process A according to the invention while using the screen shown in FIG. 74.

FIG. 75 shows a charging and imagewise exposure step. That is, a corona wire 130 provided opposite to an insulating layer 22 and a corona supply voltage source 131 is connected across the wire and a conductive sheet-like member 21 so as to project positive corona ions toward the screen 20. At the same time the screen 20 is subjected to an imagewise exposure corresponding to a document 132 to be duplicated. In the imagewise dark area of the screen 20 the photoconductive layer 23*a* remains highly resistive and thus this portion of the screen is charged in positive polarity. Whereas in the imagewise exposed area the screen is hardly charged.

Figure 76:
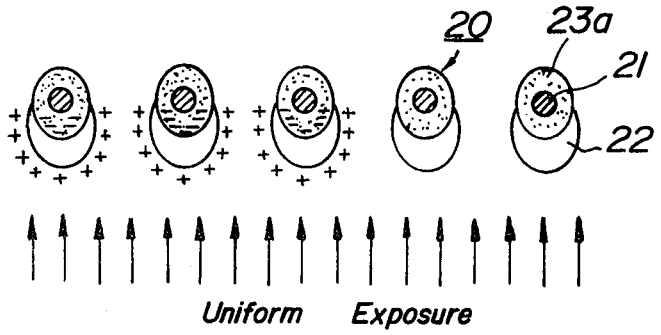

Next the screen 20 is subjected to a uniform exposure as depicted in FIG. 76. Under this uniform exposure the charges on the photoconductive layer 23*a* in the dark area disappear and negative charges are trapped at the boundary between the conductive layer 23*a* and insulating layer 22 under the influence of the positive charges deposited on the surface of insulating layer 22. In this manner the primary latent image is formed on the insulating layer 22 of screen 20. The electrostatic contrast $V_c$ of this latent image can be expressed as follows:

$$V_c = \alpha_p V_{1D} - V_{1L}.$$

Figure 77:
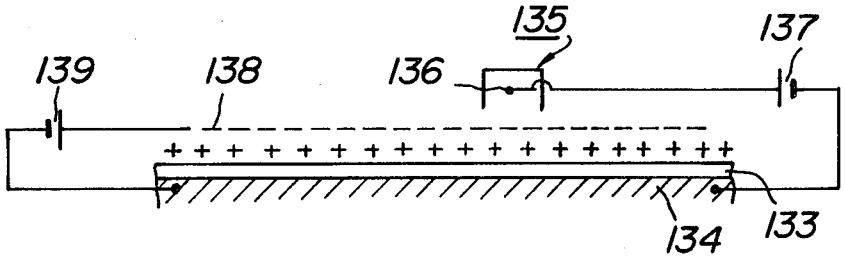

In this example use is made of a record medium which is uniformly charged beforehand. FIG. 77 shows this uniform charging step. A record medium 133 is placed on an electrically conductive plate 134 and a corona discharging device 135 is arranged above the record medium 133. Across the plate 134 and a corona wire 136 is connected a corona supply source 137. Between the record medium 133 and the corona discharging device 135 is arranged a control grid 138 which is connected to a bias voltage supply source 139. In this manner the record medium 133 can be uniformly charged to a predetermined positive voltage.

Figure 78:
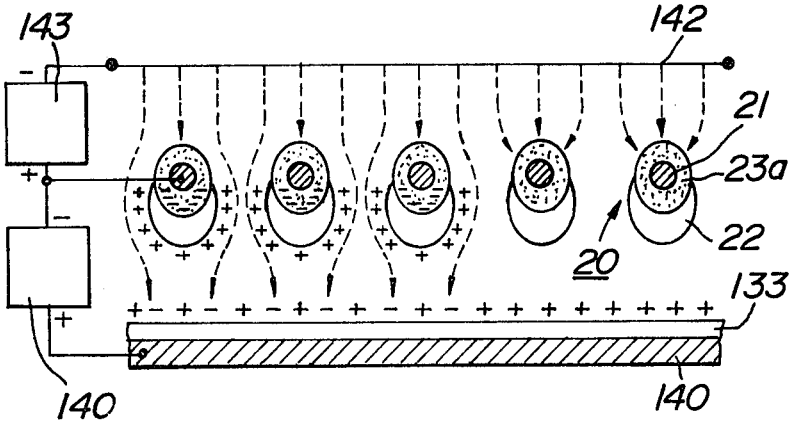

FIG. 78 shows a step for forming a secondary charge latent image on the record medium 133 with the aid of the primary charge latent image formed on the screen 20. To this end the record medium 133 is placed on a back electrode 140 and an accelerating supply source 141 is connected across the electrode and the conductive member 21 of the screen. At that side of the screen which is opposite to the side facing the record medium 133 is arranged a corona wire 142, and a corona supply voltage source 143 is connected across the wire and the conductive sheet 21 of the screen 20 in such a polarity that the wire generates corona ions having polarity opposite to that of the charges on the record medium 133. In this manner a negative corona ion stream is generated from the wire 142 as shown by broken lines in FIG. 78. Then in the imagewise exposed area of screen 20 the negative ions flow into the conductive member 21 through the photoconductive layer 23*a* having the a-type rectifying characteristic and do not reach the record medium 133. On the other hand, in the dark area of the screen 20 the negative corona ions pass through the apertures of the screen and deposit on the record medium 133 due to the fact that in this area there is formed an electric field which promotes the passage of ions through the apertures. This results in a change in the surface potential of the record medium 133 in the imagewise dark area to negative. In this manner a positive secondary charge latent image is formed on the record medium 133.

It should be noted that during the secondary latent image forming step shown in FIG. 78 the positive charges on the insulating layer 22 are more or less neutralized by the negative corona ions projected from the wire 142. However the charges trapped in the interface between the insulating and photoconductive layers 22 and 23*a* have the same polarity as the corona ions and thus the corona ion stream is effectively modulated due to the repelling action of the trapped charges. In this manner a great number of duplicated copies can be printed with the aid of the primary latent image once formed on the screen.

It should be further that the secondary latent image forming step shown in FIG. 78 may be effected simultaneously with the uniform exposure step illustrated in FIG. 76. In such a case the photoconductive layer 23*a* is not charged with the corona ions from the wire 142 and thus a secondary latent image of high quality without fog can be obtained on the record medium 133.

EXAMPLE 52

Figure 79:
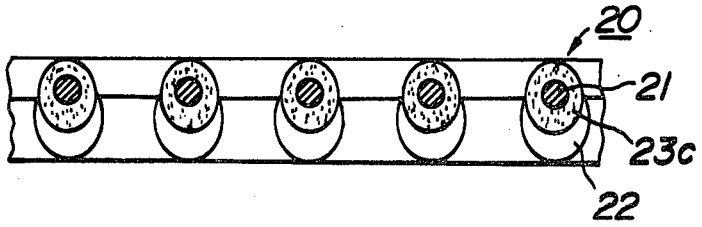
FIG. 79 is a cross section showing still another embodiment of the screen according to the invention.

In this example the primary charge latent image is formed on a photosensitive screen 20 shown in FIG. 79 in accordance with the process C. This screen is similar to that used in the last mentioned Example 51, but its photoconductive layer 23*c* is of c-type.

Figure 80:
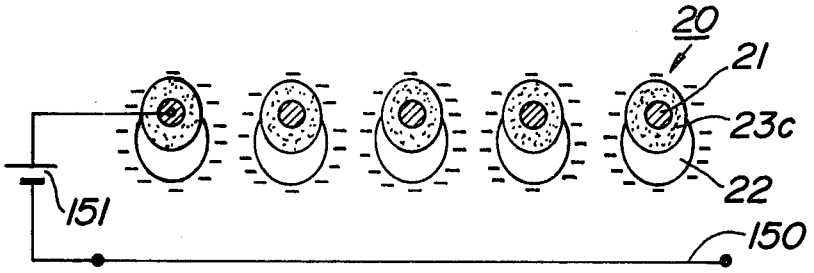
FIGS. 80, 81 and 82 are schematic diagrams depicting successive steps of the process C according to the invention while using the screen illustrated in FIG. 79.

FIG. 80 illustrates the primary uniform electrification step. A corona wire 150 is arranged opposite to an insulating layer 22 of the screen 20 and a corona supply source 151 is connected across the wire and a conductive core 21. The screen 20 is uniformly charged in negative polarity. The primary charging may be effected from the opposite side of the screen 20.

Figure 81:
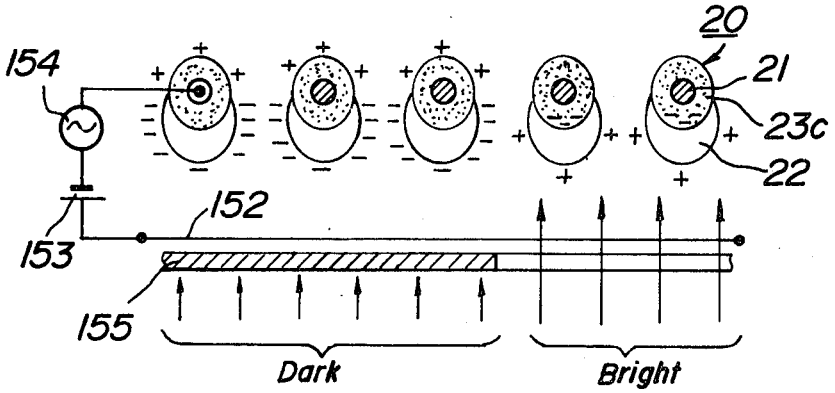

FIG. 81 shows the imagewise exposure and secondary reverse polarity charging step. A corona wire 152 is arranged opposite to the insulating layer and a D.C. supply source 153 and an A.C. supply source 154 are connected in series between the wire and the conductive member 21. The screen 20 is charged in positive polarity which is opposite to the primary charging shown in FIG. 80. At the same time the screen 20 is subjected to an imagewise exposure by means of a document 155. In the exposed area of the screen 20 since the photoconductive layer 23*a* becomes conductive the surface potential of the screen at this area becomes positive. Whereas in the imagewise dark area of screen 20 the surface potential remains unchanged. Therefore on the screen 20 is formed a latent image composed of positive and negative charges. It should be noted that the surface potential of the photoconductive layer 23c in the dark area becomes a positive saturated potential.

Figure 82:
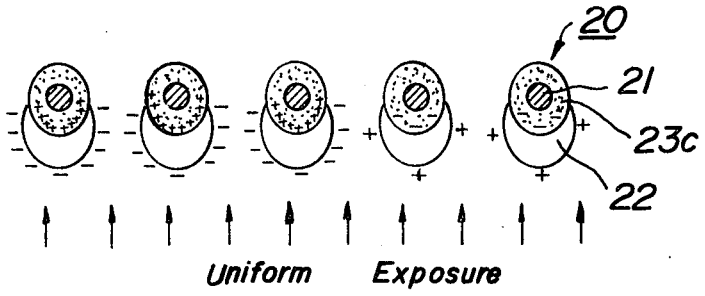

FIG. 82 shows the uniform exposure step subjected to the screen 20. During this step positive charges corresponding to the negative charges on the free surface of the insulating layer 22 are trapped in the boundary between the layers 22 and 23c and thus the surface potential of the screen becomes lower. In this manner on the insulating layer 22 is formed a primary charge latent image having a high electrostatic contrast $V_c$ represented as follows:

$$V_c = \alpha_i(V_1 - V_{2D}).$$

By means of such a primary latent image a secondary latent image can be formed on a record medium. In this case use may be made of a positive corona ion stream and in the imagewise dark area of the screen there is generated an electric field for enhancing the passage of such ion stream through the openings in the screen. During this secondary latent image forming step the screen is subjected to the uniform exposure from that side of the screen which is remote from the insulating layer 22. The corona ions are also projected toward this side of the screen.

It should be noted that the secondary charge image of negative nature may be obtained by changing the polarity of the corona ion stream.

Figure 83A:
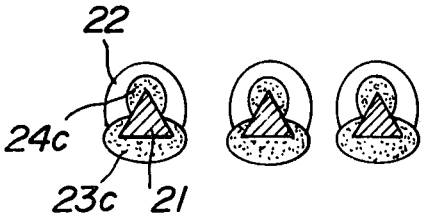
FIGS. 83*a* and 83*b* are cross sections showing still another embodiments of the photosensitive screen according to the invention.
Figure 83B:
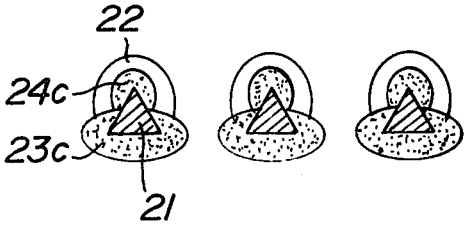

The present invention is not limited to the above mentioned embodiments and many modifications may be conceived by those skilled in the art with reference to the above various embodiments within the scope of the invention. For instance, in the Examples 47 and 48 in which the primary latent image is formed in accordance with the process E on the photosensitive screen shown in FIG. 16, in order to increase the difference in the charged potential between the imagewise dark and exposed areas it is preferable to illuminate sufficiently the first photoconductive layer 23c so as to decrease its resistance. To this end use may be made of photosensitive screens shown in FIGS. 83a and 83b. In FIG. 83a the cross section of the conductive member 21 is made triangular instead of rectangular and in FIG. 83b a photoconductive layer 23c is made widened in the direction parallel to the plane of the screen, so that a greater amount of light can be incident on the photoconductive layer 23c.

Moreover in all of the above explained examples the imagewise exposure and the primary electrification are effected from the side of the insulating layer 22 of the screen, but they may be carried out from the side of the second photoconductive layer 23. In such a case, although the difference in charged potential between the dark and exposed areas becomes larger, the sharpness or resolution of the duplicated copy image might be decreased. Thus it is preferable to effect the above steps from the side of the insulating layer 22.

Furthermore when the primary charge latent image having a sufficiently high electrostatic contrast is formed on the photosensitive screen, the uniform exposure step during the secondary charge latent image forming step may be dispensed with.

As the record medium use may be made of any charge receiving medium such as a plain paper, a charge transfer drum, roller or belt.

Various advantages of the present invention may be summarized as follows:

(1) The primary latent image having very high electrostatic contrast can be formed in accordance with a simple process.

(2) Since the primary latent image is formed on the insulating layer having extremely high resistance, this charge image can be maintained for a very long time period and thus a great number of secondary charge latent images can be formed with the aid of the once formed primary latent image.

(3) It is not necessary to apply a bias voltage to the photosensitive screen and thus the problem of spark does not occur.

(4) Since the conductive member of the screen is not exposed the charging efficiency becomes high.

(5) The construction of the screen is much simpler than the known four layer screen and thus can be manufactured easily.

(6) The screen is effectively protected against humidity and thus the decay of the charges on the screen is very small.

What is claimed is:

1. A process for electrophotographically forming a duplicated copy of a document with the aid of a photosensitive screen defined by an electrically conductive sheet-like member having a plurality of fine apertures, a first photoconductive layer applied on one side of the conductive memeber, a second photoconductive layer applied on the other side of the conductive member, an electrically insulating layer applied on the second photoconductive layer, said sheet-like conductive member being completely covered with said first and second photoconductive layers and the insulating layer, whereby corona ions do not flow directly into said sheet-like conductive member when said member is exposed to a corona discharge, said process including the steps of: forming a primary electrostatic charge image of the document; subjecting the insulating layer side of said photosenstive screen simultaneously to an imagewise exposure corresponding to the image of the document and to an electrostatic charge while the first photoconductive layer is maintained highly resistive in an imagewise dark portion; subjecting at least the first photoconductive layer of the screen to a uniform exposure so as to form a primary charge image having a high surface potential and trapped capacitively across the insulating layer in a stable manner, any other portion of the screen being free from any charge; positioning a charge retentive member opposite the insulating layer side of said photosensitive screen; and forming a secondary electrostatic charge image on the charge retentive member by projecting an ion stream toward the charge retentive member through the photosensitive screen from the side of the first photoconductive layer, while the first photoconductive layer is maintained highly conductive, whereby any charge which might deteriorate the primary charge image on the screen is inhibited from deposit on the first photoconductive layer and the ion stream is modulated in accordance with the primary charge image on the screen.

2. A process according to claim 1, further comprising, subsequent to the imagewise exposure and charging step, but prior to the uniform exposure step, a secondary opposite polarity charging step for electrostatically charging the photosensitive screen in polarity opposite to that of the primary charging.

3. A process according to claim 1, further comprising, prior to the imagewise exposure and charging step, a primary charging step for electrostatically charging uniformly the photosensitive screen in polarity opposite to that of the secondary charging which is effected simultaneously with the imagewise exposure.

4. A process according to claim 3, wherein during the primary charging step the photosensitive screen is subjected to a uniform exposure.

5. A process according to claim 2, further including, subsequent to the imagewise exposure and primary charging step, but prior to the secondary opposite polarity charging step, a step for subjecting the photosensitive screen to a uniform exposure.

6. A process according to claim 1 wherein said first and second photoconductive layers have the same rectifying characteristic which affords mainly the electrification in one polarity.

7. A process according to claim 1, wherein said first and second photoconductive layers have a non-rectifying characteristic which allows an electrification in both positive and negative polarities.

8. A process according to claim 1, wherein said first and second photoconductive layers have different characteristics selected from a group consisting of a rectifying characteristic which allows mainly a positive electrification, a rectifying characteristic which allows mainly a negative electrification and a non-rectifying characteristic which allows both positive and negative electrification.

9. A process according to claim 1, wherein said uniform exposure step and said ion stream projecting step are performed simultaneously.

10. A process according to claim 1, wherein the photosensitive screen having the primary charge latent image formed thereon is subjected to a uniform exposure during said ion stream projecting step.

11. A process according to claim 1, further comprises a step for electrostatically charging uniformly the record medium in a given polarity to a given potential prior to the formation of the secondary latent image.

12. A process according to any one of claims 2, 3, 4 and 5, wherein said secondary opposite polarity charging step is carried out by a combination of a direct current electrification and an alternating current electrification.

13. A process according to any one of claims 2, 3, 4 and 5, wherein during the secondary opposite polarity charging step a charged potential of the screen is controlled in such a manner that on the screen there is formed the primary charge latent image composed of both positive and negative charges.

14. A process according to any one of either claims 1, 2, 3, 4 or 5, wherein said secondary charge latent image forming step is repeatedly effected for the single primary charge latent image once formed on the photosensitive screen so as to form a plurality of duplicated copies.

15. A photosensitive screen for use in an electrophotographic process for forming at least one duplicated copy of a document by modulating an ion stream passing through the screen in accordance with a primary electrostatic charge latent image formed on the screen comprising: an electrically conductive sheet-like member having a plurality of fine apertures formed therein; a first photoconductive layer applied on one side of the conductive member; a second photoconductive layer applied on the other side of the conductive member; an electrically insulating member applied on the second photoconductive layer; said sheet-like conductive member being completely covered by said first and second photoconductive layer and the insulating layer, whereby corona ions do not flow directly into said sheet-like conductive member when said member is exposed to a corona discharge.

16. A photosensitive screen according to claim 15, wherein said photoconductive member has a characteristic selected from the group consisting of a rectifying characteristic which allows mainly a positive electrification, a rectifying characteristic which allows mainly a negative electrification and a non-rectifying characteristic which allows both positive and negative electrification.

17. A photoconductive screen according to claim 15, wherein the first and second photoconductive members have the same characteristic selected from the group consisting of a rectifying characteristic which allows mainly a positive electrification, a rectifying characteristic which allows mainly a negative electrification, and a non-rectifying characteristic which affords both positive and negative electrification.

18. A photoconductive screen according to claim 15, wherein the first and second photoconductive members have different characteristics from each other selected from the group consisting of a rectifying characteristic which affords mainly a positive electrification, a rectifying characteristic which allows mainly a negative electrification, and a non-rectifying characteristic which affords both positive and negative electrification.

19. A photosensitive screen according to claim 15, further comprising an electrically conductive opaque layer applied under the first photoconductive member and being in electrically contact with the conductive member.

20. A photosensitive screen according to claim 15, wherein said conductive member has such a cross section that the first photoconductive member is sufficiently exposed by light projected to the screen from the side of the insulating member.

21. A photosensitive screen according to claim 15, wherein said first photoconductive member has such a cross section that it is sufficiently illuminated by light projected toward the screen from the side of the insulating member.

22. A photosensitive screen according to claim 17, wherein said first and second photoconductive members are formed as an integral body which completely surrounds the conductive member.

* * * * *